US008391520B2

(12) United States Patent
Liou et al.

(10) Patent No.: US 8,391,520 B2
(45) Date of Patent: Mar. 5, 2013

(54) FLAT SPEAKER UNIT AND SPEAKER DEVICE THEREWITH

(75) Inventors: Chang-Ho Liou, Changhua County (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 855 days.

(21) Appl. No.: 12/541,145

(22) Filed: Aug. 13, 2009

(65) Prior Publication Data

US 2010/0104116 A1 Apr. 29, 2010

Related U.S. Application Data

(60) Provisional application No. 61/108,027, filed on Oct. 24, 2008.

(30) Foreign Application Priority Data

Mar. 10, 2009 (TW) ..... 98107677 A
May 25, 2009 (TW) ..... 98117344 A

(51) Int. Cl.
*H04R 25/00* (2006.01)

(52) U.S. Cl. ..... 381/191; 381/174

(58) Field of Classification Search ..... 381/191, 381/174

See application file for complete search history.

(56) References Cited

U.S. PATENT DOCUMENTS 3,894,199 A 7/1975 Tamura et al.
4,160,882 A 7/1979 Driver
6,188,772 B1 2/2001 Norris et al.
2009/0060233 A1 * 3/2009 Liou et al. ..... 381/191
2010/0104116 A1 4/2010 Liou et al.

FOREIGN PATENT DOCUMENTS

| | | | |
|---|---|---|---|
| CN | 2829267 | Y | 10/2006 |
| CN | 1910951 | | 2/2007 |
| CN | 1993000 | | 7/2007 |
| CN | 1997243 | A | 7/2007 |
| CN | 201210732 | Y | 3/2009 |
| JP | 2006025109 | * | 7/2004 |
| JP | 2006-25109 | | 1/2006 |
| KR | 10-2008-0040834 | | 5/2008 |
| TW | 200726290 | | 7/2007 |
| TW | 200726300 | | 7/2007 |

(Continued)

OTHER PUBLICATIONS

"International Preliminary Report on Patentability of PCT counterpart application (Form PCT/IPEA/416 & Form PCT/IPEA/409)", mailed Sep. 8, 2011, p. 1-13.

(Continued)

*Primary Examiner* — Curtis Kuntz
*Assistant Examiner* — Sunita Joshi
(74) *Attorney, Agent, or Firm* — Jianq Chyun IP Office

(57) ABSTRACT

A reliable flat speaker unit and a speaker device with the same are provided herein. A conductive electrode of a vibrating membrane of the speaker unit is disposed on both utmost sides of the speaker unit to isolate the speaker unit from environmental moisture, which can significantly improve the reliance of the speaker device. A barrier layer can optionally be disposed on the external side of the conductive electrode to further isolating the speaker unit from moisture, which can improve the reliance and the lifetime of the speaker device. In an embodiment, at least a getter is disposed inside the flat speaker unit to absorb moisture therein. The speaker unit at least includes a electret vibrating membrane with a conductive electrode, a plurality of supporting members, and a electrode structure with a plurality of holes.

39 Claims, 18 Drawing Sheets

FOREIGN PATENT DOCUMENTS

| | | |
|---|---|---|
| TW | 201018254 | 5/2010 |

OTHER PUBLICATIONS

"Office Action of Taiwan Counterpart Application", issued on Oct. 13, 2010, p. 1-p. 4, in which the listed references were cited.

"First Office Action of China Counterpart Application", issued on Mar. 23, 2012, p. 1-p. 16, in which the listed references were cited.

"Search report of PCT counterpart application", issued on Jun. 24, 2010, p. 1-p. 14.

* cited by examiner

FLAT SPEAKER UNIT AND SPEAKER DEVICE THEREWITH

CROSS-REFERENCE TO RELATED APPLICATION

This application claims the priority benefit of U.S. provisional application Ser. No. 61/108,027, filed on Oct. 24, 2008, all disclosures are incorporated therewith. This application also claims the priority benefit of Taiwan applications serial no. 98107677 and 98117344, filed on Mar. 10, 2009 and May 25, 2009. The entirety of each of the above-mentioned patent applications is hereby incorporated by reference herein and made a part of this specification.

BACKGROUND

1. Technical Field

The disclosure relates to a flat speaker having a moisture blocking characteristic.

2. Background Art

Vision and audition are the most direct sensory responses of human beings. Thus, scientists have been dedicated to developing various renewable vision and audition related systems. Moving coil speaker is still the major product in the market among all the existing renewable speakers. However, along with people's increasing demand to high quality sensory enjoyment and the ever-decreasing sizes of 3C products (Computer, Communication, and Consumer Electronics), speakers which have low power consumption, light weights, and small sizes and are designed according to human factors engineering are to be developed and broadly applied in the near future.

The existing speakers can be categorized into direct and indirect types according to their radiation patterns or can be categorized into moving coil speaker, piezoelectric speaker, and electrostatic speaker according to the driving patterns thereof. The moving coil speaker is currently the most commonly used and most mature product. However, a moving coil speaker cannot be compressed due to the physical structure thereof. Accordingly, moving coil speaker is not suitable for 3C products and home entertainment systems which have their sizes reduced constantly.

A piezoelectric speaker pushes a membrane to produce sounds based on the piezoelectric effect of an electrical material (i.e., the material is deformed when an electric field is supplied thereon). A piezoelectric speaker has a compressed and small structure. Electrostatic speaker is a hi-end earphone or speaker in the current market. According to the operation principle of a conventional electrostatic speaker, a conductive membrane is disposed between two open-hole electrical backplates to form a capacitor. An electric field is produced by supplying a DC bias to the membrane and an AC voltage to the two electrical backplates. The conductive membrane is driven by the electrostatic force generated by the electric field to vibrate and accordingly produce audio. The conventional electrostatic speaker needs a bias of up to hundreds or even thousands voltages, and accordingly a high-cost and bulky amplifier has to be used which makes the conventional electrostatic speaker difficult to popularize.

Audio is a major element in the future applications of flexible electronics. However, flexible electronics has to have the characteristics of softness, thinness, low driving voltage, and high flexibility. Thus, how to fabricate elements having the characteristics of flexible electronics has become a major subject.

Currently, the manufacture of speakers still applies the design production method as that for a single unit as illustrated in U.S. Pat. No. 3,894,199.

As for the electrostatic speaker, for example, in U.S. Pat. No. 3,894,199, an electro-acoustic transducer structure is mainly provided, as shown in FIG. 1. The structure includes two fixed electrode structures 110 and 120 placed on two sides. The fixed electrode structures 110 and 120 have a plurality of pores for scattering the sounds generated. A vibrating film 130 is disposed between the fixed electrode structures 110 and 120. A fixing structure 140 is made of an insulation material, and used to fix the fixed electrode structures 110 and 120 and the vibrating film 130. The fixed electrode structures 110 and 120 are respectively connected to an AC source 160 through a transformer 150. When an AC signal is transmitted to the fixed electrode structures 110 and 120, a potential is alternately changed to enable the vibrating film 130 to generate vibration due to the potential difference on two sides thereof, and thereby generating corresponding sound. However, the above configuration needs to enhance the sound-pressure output, so an additional power element is required to work together with the driving process. In this manner, the apparatus not only has a large volume, but more elements are used, and the cost is relatively high. In addition, the fixing structure 140 must fix the fixed electrode structures 110 and 120 and the vibrating film 130, so the electro-acoustic transducer structure cannot achieve the flexible characteristics.

SUMMARY

A flat speaker unit including a first vibrating membrane, a second vibrating membrane, an electrode structure having a plurality of holes, a first supporting member layer, and a second supporting member layer is provided in the embodiment. The surfaces of the first vibrating membrane and the second vibrating membrane respectively have a first conductive electrode and a second conductive electrode with moisture blocking characteristic. The electrode structure having the holes is disposed between the first vibrating membrane and the other surface of the second vibrating membrane. The first supporting member layer and the second supporting member layer are disposed respectively between the first vibrating membrane and the electrode structure having the holes and between the second vibrating membrane and the electrode structure having the holes. The first vibrating membrane, the first supporting member layer, the electrode structure with the holes, the second supporting member layer, and the second vibrating membrane stack into a stacked structure. The first conductive electrode and the second conductive electrode are placed on the opposite outer-most sides of the stacked structure, and form a resonance chamber of the flat speaker unit within the stacked structure. The resonance chamber is a hermetic chamber or a non-hermetic chamber.

A speaker device constituted by a plurality of flat speaker units aforementioned is provided in the embodiment. Herein, the flat speaker units are at least stacked into a two-layered structure.

BRIEF DESCRIPTION OF THE DRAWINGS

The accompanying drawings are included to provide a further understanding of the embodiment, and are incorporated in and constitute a part of this specification. The drawings illustrate embodiments and, together with the description, serve to explain the principles of the embodiment.

FIG. 2I is a schematic three dimensional view of a getter in FIG. 2H.

DESCRIPTION OF EMBODIMENTS

Figure 1:
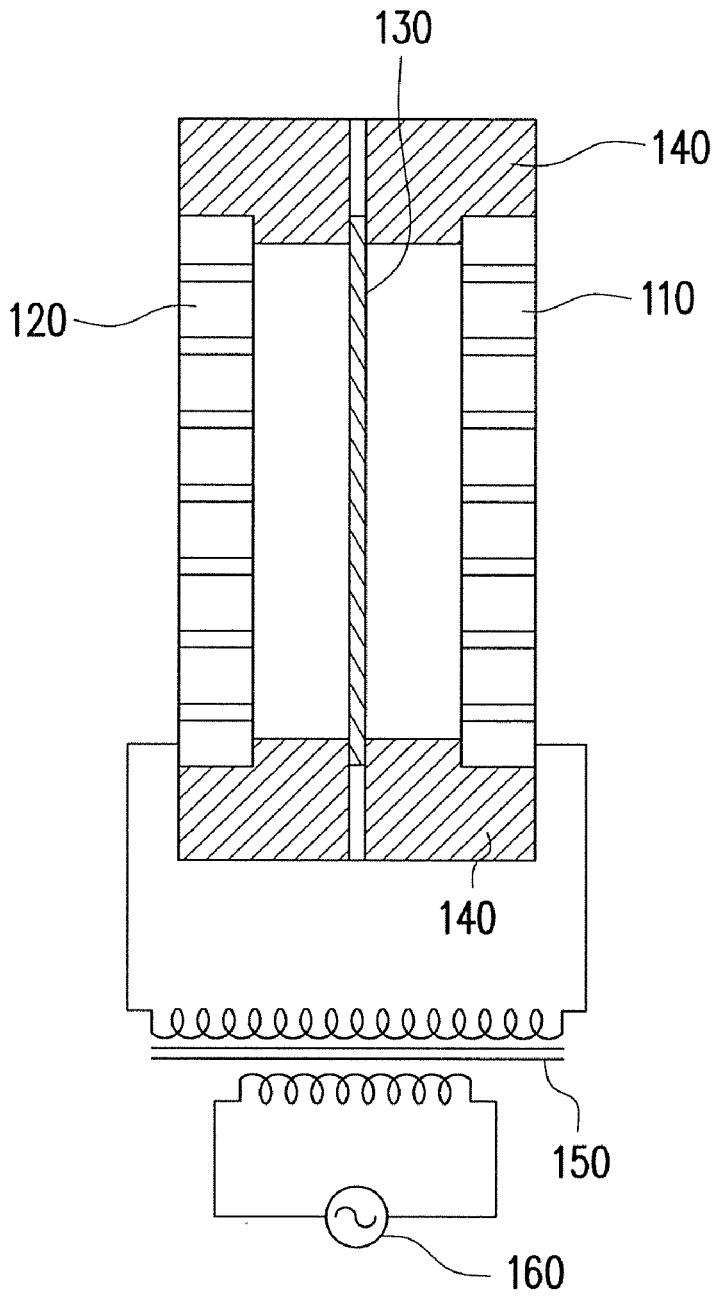
FIG. 1 (PRIOR ART)
FIG. 1 is a schematic cross-sectional view illustrating a structure of a conventional electrostatic speaker.

The embodiment provides a reliable flat speaker structure that inputs voltages into flat speaker modules simultaneously according to signals. Moreover, the flat speaker structure utilizes electret vibrating membranes with ferroelectric effect and conductive electrode layers formed thereon with moisture blocking characteristic. The conductive electrode layers are placed on outer-most sides of the flat speaker unit to enhance the reliability thereof. In one embodiment, combinations of a plurality of flat speaker units are further performed to increase the total sound-pressure output and thus omit the disposition of barrier layers on the external sides of the speaker unit. The speaker structure provided in the embodiment further solves the complexity in the structure and circuit of the flat speaker when sound-pressure power has increased.

In one embodiment, barrier layers are optionally disposed on the external sides of the flat speaker unit to further isolate the flat speaker unit from moisture, thereby improving the reliability and lifetime of the flat speaker unit.

In one embodiment, a getter for absorbing moisture is disposed within the resonance chamber of the flat speaker unit to further enhance the moisture blocking effect for maintaining the dry condition and enhancing the reliability of the flat speaker unit. Moreover, the getter is categorized into a physical getter and a chemical getter. The chemical getter is classified into an evaporation getter and a non evaporation getter. In the embodiment, the getter the getter is powder-like, disc-like, strip-like, tube-like, ring-like, cup-like, or the like.

The flat speaker provided in the embodiment has a simple structure and can be manufactured with existing techniques. Thus, the flat speaker is suitable for mass production, which consequently reduces the manufacturing cost effectively. The embodiment enhances the reliability and the sound producing efficiency of the flat speaker modules, which in turn makes the embodiment become a significant technique for flat speakers. The assembly of the flat speaker is optionally constituted by flexible speaker units with flexible and bendable characteristics. Obviously, materials whose characteristics remain unaffected in a bended state should be applied.

In one embodiment, a reliable flat speaker structure provided in the embodiment drives a plurality of flat speaker units with the same set of signals. This method effectively enhances the sound-producing efficiency of the flat speaker, thereby achieving the required sound-pressure specification in the application design of the flat speaker. In the embodiment, the multiple sets of flat speaker units stacked together utilize the electret vibrating membranes with ferroelectric characteristics and the conductive electrode layers formed thereon with moisture blocking characteristics. The conductive electrode layers are disposed on the external sides of the flat speaker units to enhance the reliability of the flat speaker units.

In another embodiment, a set of signals is utilized for driving the reliable flat speaker units provided in the embodiment to effectively enhance the sound-producing efficiency of the flat speaker and produce a larger sound-pressure by the flat speaker under the same area. In one embodiment, the flat speaker unit provided in the embodiment is assembled by electret vibrating membranes with conductive electrode layers, supporting members, electrode layers, and an insulating layer.

The embodiment utilizes the charge characteristics and electrostatic effect within the electret material. When the electret vibrating membrane is stimulated by an external voltage, the electret vibrating membrane generates a deformation that is vertical or perpendicular to the surface of the vibrating membrane. If the four sides of the vibrating membrane are fixed, the deformation originally vertical or perpendicular to the vibrating membrane surface is converted into a bended deformation, so as to drive the air around the vibrating membrane to generate sound. As known from the electrostatic force formula and energy laws, the force applied on the vibrating film equals to the capacitance value of the whole speaker multiplied by the intensity of the internal electric field and the externally-inputted sound voltage signal, and the larger the force applied on the vibrating film is, the louder the outputted sound is.

According to Coulomb's Law, a product of charges of two charged objects is directly proportional to the electrostatic force interacted there-between, and inversely proportional to a square of the distance between the two objects. If both of the two charges are positive or negative, the objects are repelled by repulsive electrostatic force. If one of the charges is positive, and the other is negative, the objects are attracted by attractive electrostatic force. The electret material utilized in the embodiment is an electro-sound actuator with an electret vibrating membrane composite material including micro order or nano order pores. The structure thereof is formed by an electret vibrating membrane being clamped equal distantly between two charged metal electrodes having a plurality of holes. Moreover, the structure of the electro-sound actuator is a capacitor device, for example. The metal electrodes having the plurality of holes aforementioned are respectively applied with positive and negative charges from the audio signal. According to Coulomb's Law, the electret vibrating membrane is forced by an attractive and a repulsive electrostatic forces at the same time, and the electrostatic force formula of the force applied to the vibrating membrane unit in each unit area can be represented by Formula 1.

$$P = \frac{2V_{in}V_e\varepsilon_0\left(\frac{1}{S_a} + \frac{\varepsilon_e}{S_e}\right)\varepsilon_e S_e}{(S_e + \varepsilon_e S_a)^2} \quad \text{(Formula 1)}$$

In Formula 1, the permittivity of vacuum $\in_0 = 8.85*10^{-12}$ F/m, an electret dielectric constant is $\in_e$, an electret thickness is $S_e$, an air layer thickness is $S_a$, an input signal voltage is $V_{in}$, an electret voltage is $V_e$, and the force applied on the vibrating-membrane in unit area is P. As known from Formula 1, the electrostatic force is directly proportional to the product of the bias and the audio signal voltage, and is inversely proportional to the distance between the metal electrodes having the plurality of holes and the electret vibrating membrane. Therefore, if the electrostatic speaker can provide high ferroelectricity under the same distance, then the required electrostatic force can be achieved with a relatively low audio AC voltage. The embodiment uses electret piezoelectric composite materials with micro order or nano order pores to provide a ferroelectric amount of over hundreds of volts. According to the above electrostatic formula, the audio voltage may be reduced to tens of volts, so as to improve the practicality of the flat speaker of the embodiment.

As known from the theory aforementioned, the electret vibrating membrane is forced by a push-pull electrostatic force under the effect of the positive and negative bias of the two metal electrodes, such that the electret vibrating membrane vibrates, therefore compresses the surrounding air to output sound.

In the embodiment, the electret vibrating membrane can be an electret piezoelectric vibrating membrane, such as a dielectric material being electrized to allow it to keep static charges for a long period of time. Moreover, the electret vibrating membrane is a vibrating membrane manufactured from a single-layered dielectric material or multi-layered dielectric materials. Examples of this dielectric material include fluorinated hylenepropylene (FEP), polytetrafluoethylene (PTFE), polyvinylidene fluoride (PVDF), fluorine polymer materials, or other suitable materials. The dielectric material may include holes having diameters in micro-scale or nanometer-scale. The electret vibrating membrane is a vibrating membrane capable of maintaining the static charges and piezoelectricity for a long time after the dielectric material has been electrized, and includes with micro order or nano order pores to increase the transmittance and piezoelectric characteristics. Thus, after being charged by corona, dipolar charges are generated in the material to generate the ferroelectric effect.

By utilizing the moisture blocking characteristics of the vibrating membrane materials aforementioned, the vibrating membrane materials having the conductive electrode layers in the flat speaker structure are disposed on outer-most sides of the unit structure. The structural design of the flat speaker unit for isolating moisture is simplified, which greatly facilitates mass production in the future. In addition, barrier layers with moisture blockage effects can be disposed on the external sides of the flat speaker unit to further improve the reliability and lifetime of the flat speaker unit.

Currently, the sound volume increase of the sound-pressure of the flat speaker units within a short period of time is limited to materials used or other factors. The improvements are focusing on increasing the ferroelectric amount in the electret vibrating membrane or improving the design of acoustic structure. However, the former methods both require time-consuming studies and can not fulfill the demand of the application design in increasing the sound volume within a short time.

In another embodiment, the flat speaker units are integrated to produce sounds by driving a plurality of flat speaker units without changing the design of the signal source.

Figure 2A:
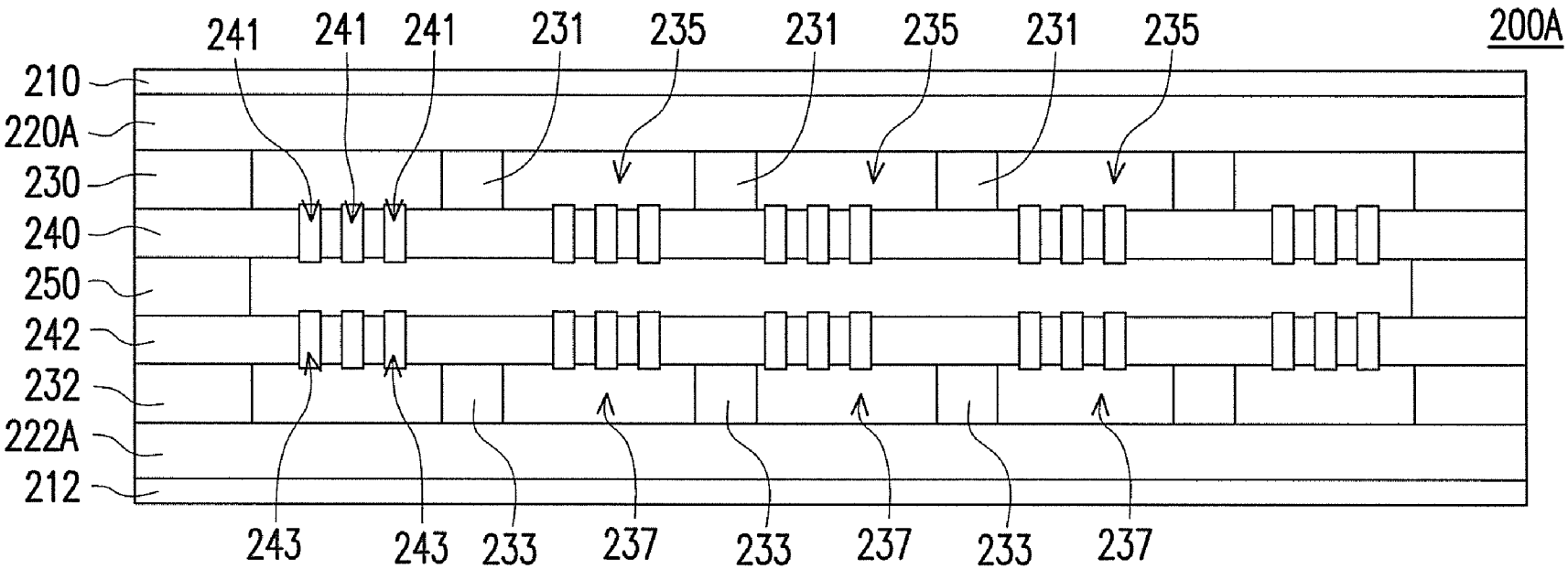
FIG. 2A is a cross-sectional view of a double-layered flat speaker according to an embodiment.
Figure 2B:
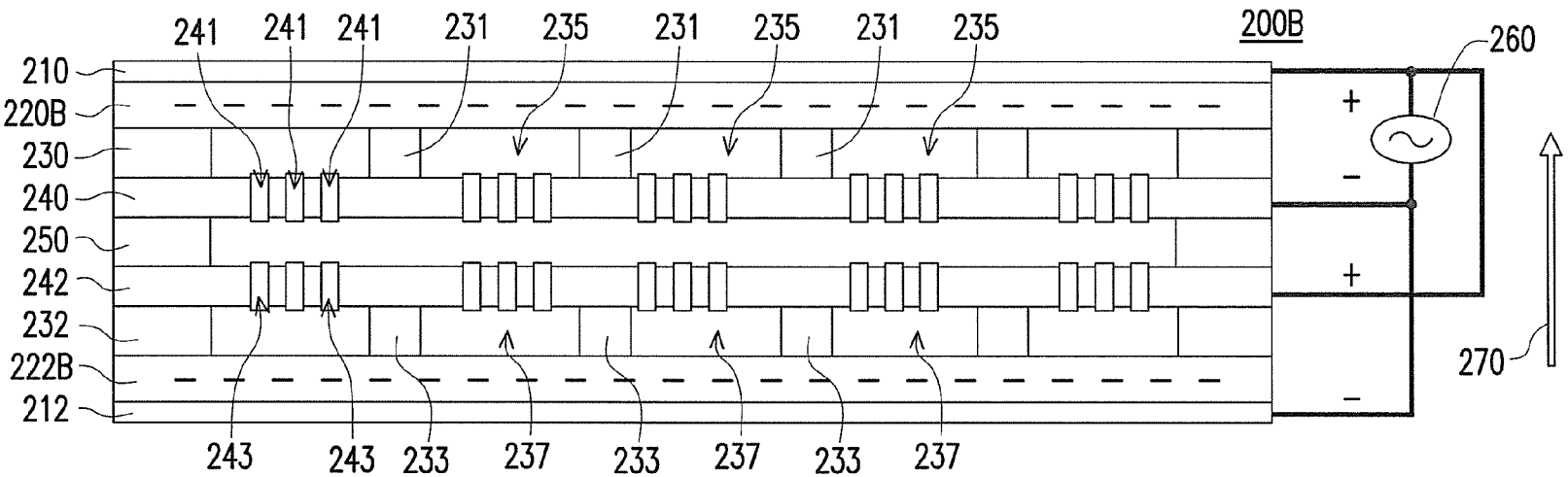
FIG. 2B and FIG. 2C are schematic cross-sectional views illustrating a unit structure of a double-layered flat speaker with the same polarity according to an embodiment.
Figure 2C:
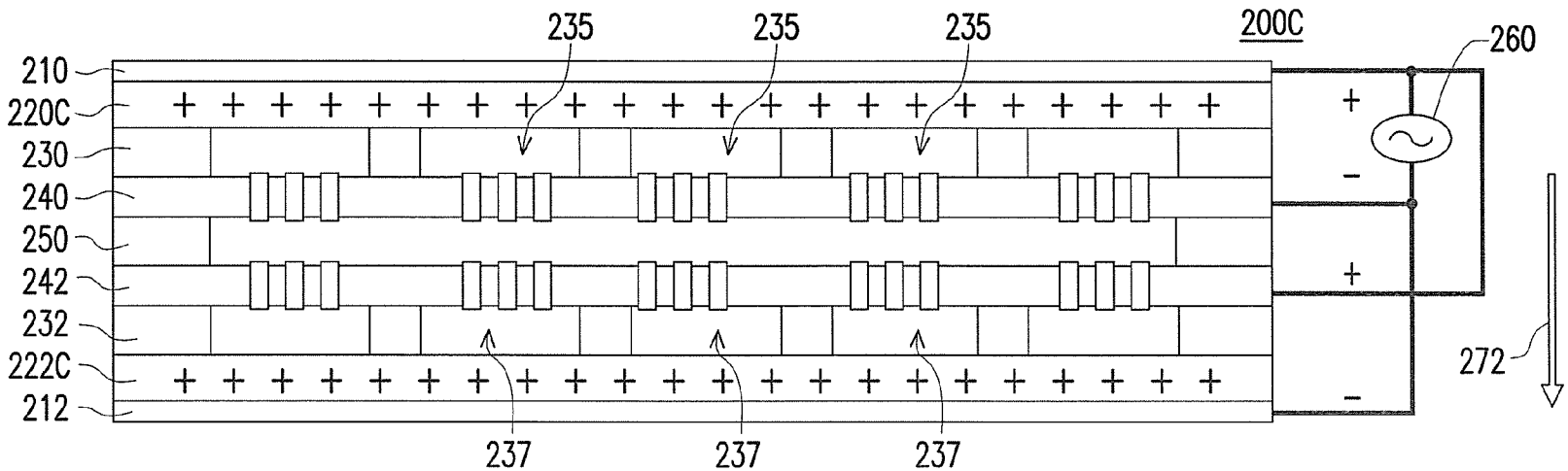
Figure 2D:
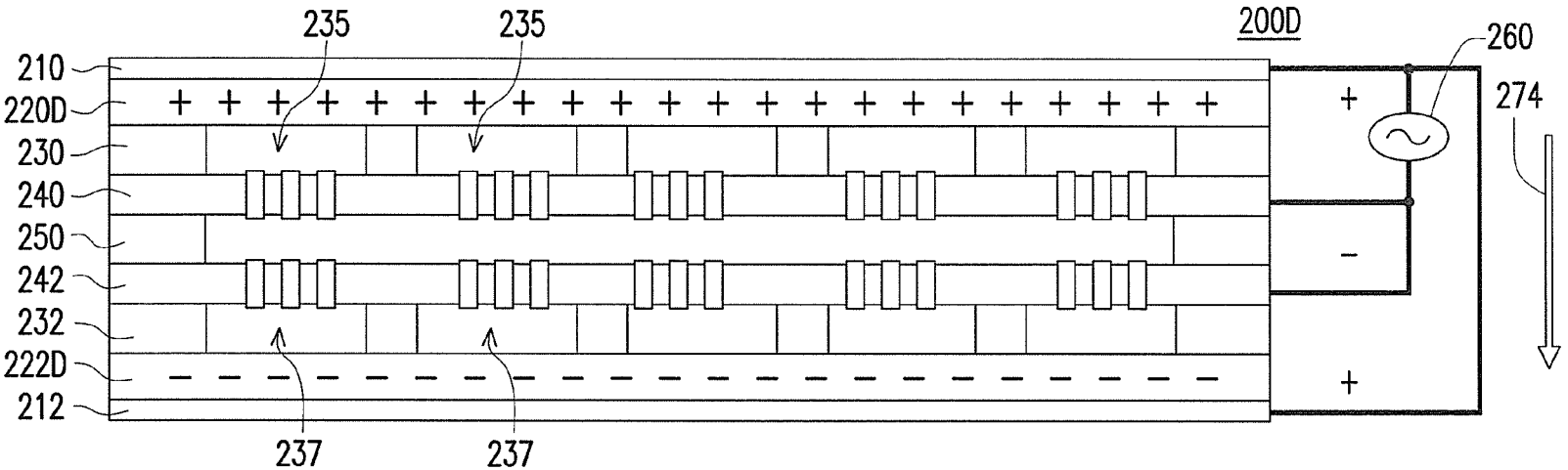
FIG. 2D and FIG. 2E are schematic cross-sectional views illustrating a single speaker unit of a double-layered flat speaker with opposite polarities according to an embodiment.
Figure 2E:
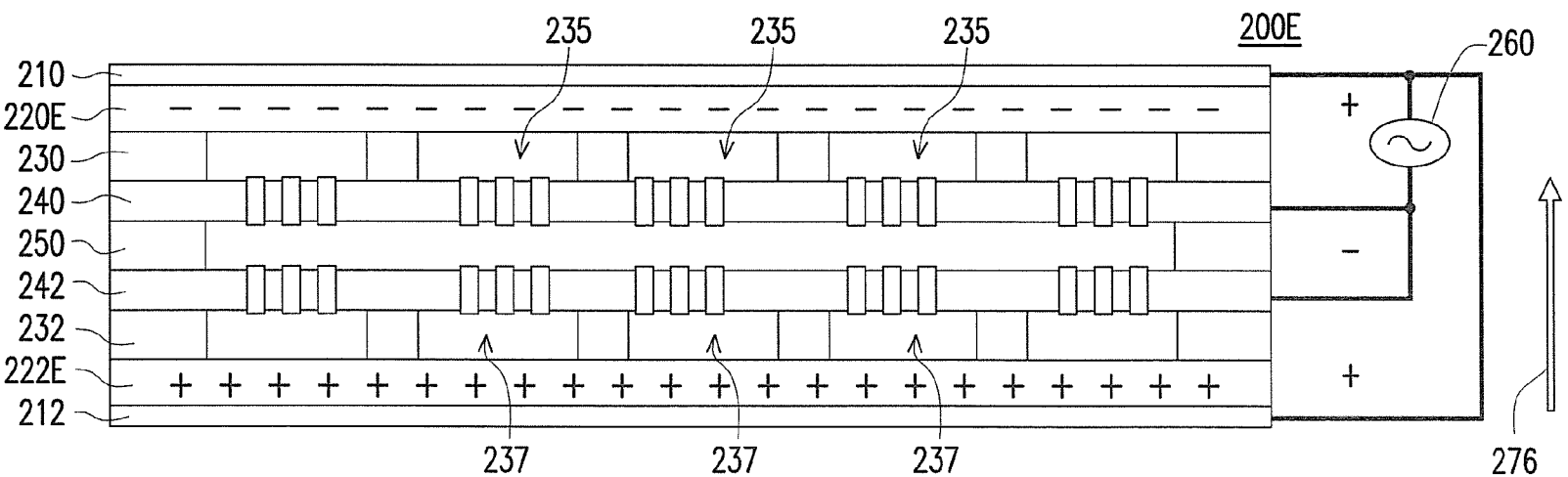

In the following, different embodiments illustrate the reliable speaker structure provided in the embodiment and the use of a plurality of stacked structures. Double-Layered Flat Speaker Unit With The Same Polarity FIG. 2A is a cross-sectional view of a double-layered flat speaker according to an embodiment. FIG. 2B and FIG. 2C are schematic cross-sectional views illustrating a unit structure of a double-layered flat speaker with the same polarity according to an embodiment. FIG. 2D and FIG. 2E are schematic cross-sectional views illustrating a unit structure of a double-layered flat speaker with opposite polarities according to an embodiment. In these embodiments, the moisture blocking characteristics of the vibrating membrane materials are utilized, so that the vibrating membrane materials having the conductive electrode layers (such as metal electrodes) in the flat speaker structure are disposed on outer-most sides of the unit structure. The structural design of the flat speaker unit for isolating moisture is therefore simplified, which greatly facilitates mass production in the future. In addition, barrier layers with moisture blockage effects can be disposed on the external sides of the flat speaker unit to further improve the reliability and lifetime of the flat speaker unit. The barrier layers are shown in FIG. 2J.

Firstly, referring to FIG. 2B, a flat speaker unit 200B is assembled by stacking an upper and a lower vibrating membrane structures and electrode structures. Moreover, an insulating layer is disposed in-between for electrical isolation. The vibrating membrane structure is assembled by a moisture blocking conductive layer and a vibrating membrane, such as a metal electrode 210 and a vibrating membrane 220B of the upper layer and a metal electrode 212 and a vibrating membrane 222B of the lower layer as illustrated in the diagram. Each vibrating membrane structure has a corresponding electrode structure, such as an electrode 240 facing the vibrating membrane 220B and an electrode 242 facing the vibrating membrane 222B. The electrodes have a plurality of sound holes respectively, i.e. sound holes 241 and 243 as shown in the diagram, which allow the air flow between the resonance chambers.

In addition, supporting member layers are optionally disposed between each vibrating membrane structure and the corresponding electrode structure thereof to form a resonance chamber configured by the vibrating membrane 220B to produce sounds. Examples of the supporting member layers include a supporting member layer 230 between the vibrating membrane 220B and the electrode 240 or a supporting member layer 232 between the vibrating membrane 222B and the electrode 242. The supporting member layer 230 has a plurality of supporting members 231, which are arranged in different patterns. The supporting member layer 232 has a plurality of supporting members 233, which are arranged in different patterns. As a result, resonance chambers 235 and 237 are formed respectively as illustrated in the diagram.

The pattern structure of the supporting member layer can solve the possible electrostatic effect generated between the vibrating membranes and the electrodes in the flat speaker structure. For example, the supporting member layer 230 between the electrode 240 and the vibrating membrane 220B is designed with different layout patterns based on different demands. A geometrical arrangement can be performed according to the electrostatic effect of the vibrating membrane 220B, and the geometrical arrangement includes rectangular-shaped, circular-shaped, triangular-shaped, or the like. These geometrical configurations are arranged based on the consideration of the distances between the supporting members or the heights of the supporting members. Furthermore, the design of the entire layout of the supporting members also considers the arrangement methods such as dot-shaped, grid-shaped, or cross-shaped. As for the configuration of the supporting members, different geometrical shapes, including trigonal prism-shaped, cylindrical-shaped, or rectangular-shaped can be used.

The embodiment utilizes the charge characteristics and electrostatic effect within the electret material. Herein, the vibrating membrane can be an electret piezoelectric material that is charged with positive or negative charges so as to generate different effects. In the embodiment, the vibrating membranes 220B and 222B of the flat speaker unit 200B both carry negative charges. The structure of the double-layered flat speaker unit with the same negative polarity provided in the embodiment is represented herein. A signal source 260 configured to provide audio signals is connected to the flat speaker unit 200B as illustrated in FIG. 2B. One end of the signal source 260 is connected to the metal electrode 210 of the vibrating membrane 220B and the electrode 242 simultaneously. The other end of the signal source 260 is connected to the metal electrode 212 of the vibrating membrane 222B and the electrode 240 simultaneously.

When the positive voltage of the signal source 260 is delivered to the metal electrode 210, an attractive force is generated between the positive voltage on the metal electrode 210 and the negative charges on the vibrating membrane 220B. Moreover, when the negative voltage of the signal source 260 is delivered to the electrode 240, a repulsive force is generated between the negative voltage of the electrode 240 and the negative charges on the vibrating membrane 220B. Therefore, the vibrating membrane 220B bends away from and expands the resonance chamber 235. On the other hand, under the same situation, when the positive voltage of the signal source 260 is delivered to the electrode 242, an attractive force is generated between the positive voltage on the electrode 242 and the negative charges on the vibrating membrane 222B. When the negative voltage of the signal source 260 is delivered to the metal electrode 212, a repulsive force is generated between the negative voltage on the metal electrode 212 and the negative charges on the vibrating membrane 222B. As a result, the vibrating membrane 222B bends toward and compresses the resonance chamber 237. Thus, the forced direction of the vibrating membranes is as that shown by a reference number 270.

FIG. 2B merely illustrates one of the voltage-phases of the audio signals of the signal source 260, but the embodiment is not limited thereto. For instance, when the voltage-phase input of the source signal 260 has changed, the positive voltage of the source signal 260 is delivered to the metal electrode 212 of the vibrating membrane 222B and the electrode 240, and the negative voltage is delivered to the metal electrode 210 of the vibrating membrane 220B and the electrode 242, the forced direction of the vibrating membranes is opposite to that as shown by the reference number 270.

The flat speaker unit 200B of the embodiment utilizes the charge characteristics and electrostatic effect within the electret material. When the electret vibrating membrane is stimulated by an external voltage, the electret vibrating membrane generates a deformation that is vertical or perpendicular to the surface of the vibrating membrane. If the four sides of the vibrating membrane are fixed, the deformation vertical or perpendicular to the vibrating membrane surface is converted into a bended deformation, so as to drive the air surrounding the vibrating membrane to generate sound. The phase-alternating audio signals provided by the signal source 260 allows the flat speaker unit 200B to produce sounds of different frequencies or sound volumes through the different forced directions of the vibrating membranes.

In another embodiment, referring to FIG. 2C, a flat speaker unit 200C is a cross-sectional view illustrating a double-layered flat speaker unit with the same polarity according to the embodiment. As the structure of FIG. 2C is similar to that of FIG. 2B, identical components are labeled with the same numbers and thus not repeated herein. However, different from FIG. 2B, vibrating membranes 220C and 222C in FIG. 2C are both charged with positive charges. Here, the structure of the double-layered flat speaker unit with the same positive polarity provided. In the embodiment is represented. A signal source 260 configured to provide audio signals is connected to the flat speaker unit 200C as illustrated in FIG. 2C. One end of the signal source 260 is connected to the metal electrode 210 of the vibrating membrane 220B and the electrode 242 simultaneously. The other end of the signal source 260 is connected to the metal electrode 212 of the vibrating membrane 222C and the electrode 240 simultaneously.

When the positive voltage of the signal source 260 is delivered to the metal electrode 210, a repulsive force is generated between the positive voltage on the metal electrode 210 and the positive charges on the vibrating membrane 220C. Moreover, when the negative voltage of the signal source 260 is delivered to the electrode 240, an attractive force is generated between the negative voltage of the electrode 240 and the positive charges on the vibrating membrane 220C. Therefore, the vibrating membrane 220C bends toward and compresses the resonance chamber 235 in the direction of the a 272 shown in the diagram.

When the positive voltage of the signal source 260 is delivered to the electrode 242, a repulsive force is generated between the positive voltage on the electrode 242 and the positive charges on the vibrating membrane 222C. When the negative voltage of the signal source 260 is delivered to the metal electrode 212, an attractive force is generated between the negative voltage of the metal electrode 212 and the positive charges on the vibrating membrane 222C. Therefore, the vibrating membrane 222C bends away from and expands the resonance chamber 237 in the direction of the reference number 272 shown in the diagram. Thus, the forced direction of the vibrating membranes is as that shown by the reference number 272.

FIG. 2C illustrates one of the voltage-phases of the audio signals of the signal source 260, but the embodiment is not limited thereto. For example, when the voltage-phase input of the source signal 260 has changed, the positive voltage of the source signal 260 is delivered to the metal electrode 212 of the vibrating membrane 222C and the electrode 240, and the negative voltage is delivered to the metal electrode 210 of the vibrating membrane 220C and the electrode 242, the forced direction of the vibrating membranes is opposite to that as shown by the reference number 272. The phase-alternating audio signals provided by the signal source 260 allows the flat speaker unit 200C to produce sounds of different frequencies or sound volumes through the different forced directions of the vibrating membranes.

Double-Layered Flat Speaker Unit with the Same Polarity

Referring to FIG. 2D and FIG. 2E simultaneously, in another embodiment, a double-layered flat speaker unit structure with opposite polarities is applied and illustrated in the following.

Referring to FIG. 2D, a flat speaker unit 200D is a cross-sectional view illustrating a double-layered flat speaker unit with opposite polarities of the embodiment. As the structure of FIG. 2D is similar to that of FIG. 2B, identical components are labeled with the same numbers and thus not repeated herein. FIG. 2D is different from FIG. 2B in that a vibrating membrane 220D is charged with positive charges and a vibrating membrane 222D is charged with negative charges. That is, the upper and lower vibrating membranes are charged with charges of opposite polarities, and this represents the structure of the double-layered flat speaker unit with opposite polarities provided in the embodiment. The signal source 260 configured to provide the audio signals is connected to the flat speaker unit 200D as illustrated in FIG. 2D. One end of the signal source 260 is connected to the metal electrode 210 of the vibrating membrane 220D and the metal electrode 212 of the vibrating membrane 222D simultaneously. The other end of the signal source 260 is connected to the electrodes 240 and 242 simultaneously.

When the positive voltage of the signal source 260 is delivered to the metal electrode 210, a repulsive force is generated between the positive voltage on the metal electrode 210 and the positive charges on the vibrating membrane 220D. Moreover, the negative voltage of the signal source 260 is delivered to the electrode 240, and an attractive force is generated between the negative voltage of the electrode 240 and the positive charges on the vibrating membrane 220D. Therefore, the vibrating membrane 220D bends toward and compresses the resonance chamber 235 in the direction of a reference number 274 shown in the diagram.

When the negative voltage of the signal source 260 is delivered to the electrode 242, a repulsive force is generated between the negative voltage on the electrode 242 and the negative charges on the vibrating membrane 222D. When the positive voltage of the signal source 260 is delivered to the metal electrode 212, an attractive force is generated between the positive voltage of the metal electrode 212 and the negative charges on the vibrating membrane 222D. Therefore, the vibrating membrane 222D bends away from and expands the resonance chamber 237 in the direction of the reference number 274 shown in the diagram. Thus, the forced direction of the vibrating membranes is as that shown by the reference number 274.

FIG. 2D illustrates one of the voltage-phases of the audio signals of the signal source 260, but the embodiment is not limited thereto. For instance, when the voltage-phase input of the source signal 260 has changed, the negative voltage of the source signal 260 is delivered to the metal electrodes 210 and 212, and the positive voltage is delivered to the electrodes 240 and 242 simultaneously, then the forced direction of the vibrating membranes is opposite to that as shown by the reference number 274. The phase-alternating audio signal provided by the signal source 260 allows the flat speaker unit 200D to produce sounds of different frequencies or sound volumes through the different forced directions of the vibrating membranes.

Referring to FIG. 2E, a flat speaker unit 200E is a cross-sectional view illustrating a double-layered flat speaker unit with opposite polarities according to another embodiment. As the structure of FIG. 2E is similar to that of FIG. 2B, identical components are labeled with the same numbers and thus not repeated herein. FIG. 2E is different from FIG. 2B in that a vibrating membrane 220E is charged with positive charges and a vibrating membrane 222E is charged with negative charges. That is, the upper and lower vibrating membranes are charged with charges of opposite polarities, and this represents the structure of the double-layered flat speaker unit with opposite polarities provided in the embodiment. The signal source 260 configured to provide the audio signal is connected to the flat speaker unit 200E as illustrated in FIG. 2E. One end of the signal source 260 is connected to the metal electrode 210 of the vibrating membrane 220E and the metal electrode 212 of the vibrating membrane 222E simultaneously. The other end of the signal source 260 is connected to the electrodes 240 and 242 simultaneously.

When the positive voltage of the signal source 260 is delivered to the metal electrode 210, an attractive force is generated between the positive voltage on the metal electrode 210 and the negative charges on the vibrating membrane 220E. Moreover, when the negative voltage of the signal source 260 is delivered to the electrode 240, a repulsive force is generated between the negative voltage of the electrode 240 and the negative charges on the vibrating membrane 220E. Therefore, the vibrating membrane 220E bends away from and expands the resonance chamber 235 in the direction of a reference number 276 shown in the diagram.

When the negative voltage of the signal source 260 is delivered to the electrode 242 having the plurality holes, an attractive force is generated between the negative voltage on the electrode 242 and the positive charges on the vibrating membrane 222E. When the positive voltage of the signal source 260 is delivered to the metal electrode 212, a repulsive force is generated between the positive voltage of the metal electrode 212 and the positive charges on the vibrating membrane 222E. Therefore, the vibrating membrane 222E bends toward and compresses the resonance chamber 237 in the direction of the reference number 276 shown in the diagram. Thus, the forced direction of the vibrating membranes is as that shown by the reference number 276.

FIG. 2E illustrates one of the voltage-phases of the audio signals of the signal source 260, but the embodiment is not limited thereto. For instance, when the voltage-phase input of the source signal 260 has changed, the negative voltage of the source signal 260 is delivered to the metal electrodes 210 and 212, and the positive voltage is delivered to the electrodes 240 and 242 simultaneously, then the forced direction of the vibrating membranes is opposite to that as shown by the mark 276. The phase-alternating audio signals provided by the signal source 260 allows the flat speaker unit 200E to produce sounds of different frequencies or sound volumes through the different forced directions of the vibrating membranes.

Figure 2F:
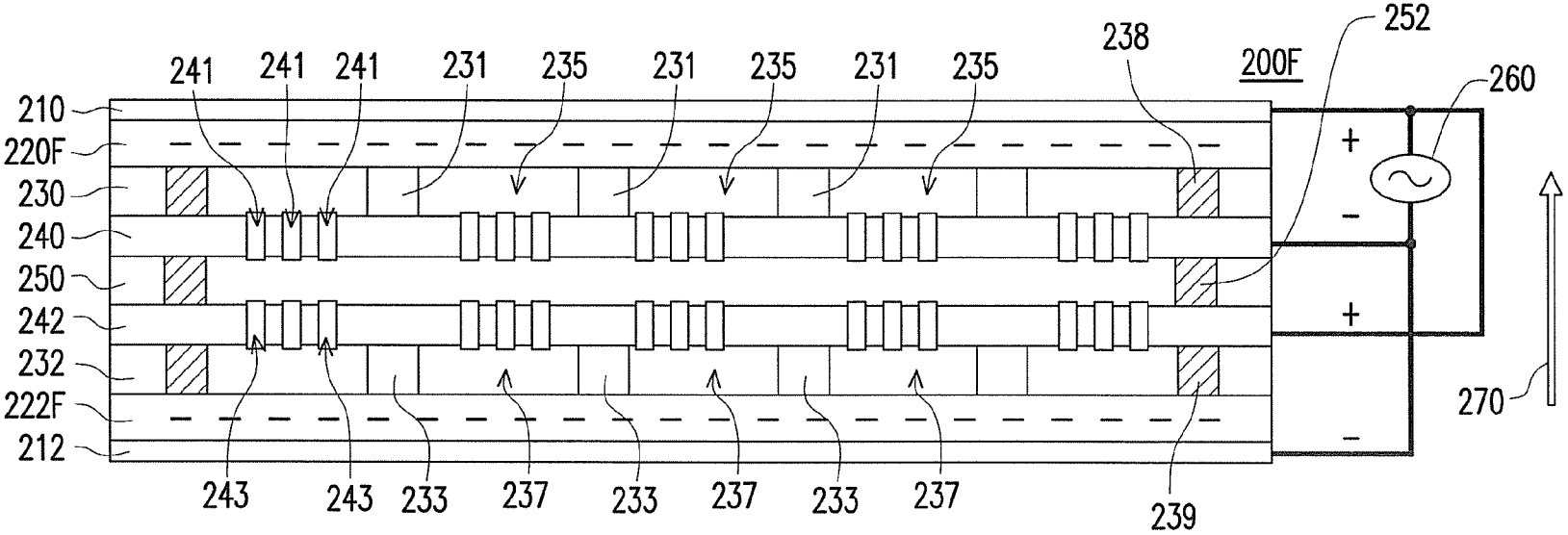
FIG. 2F is a cross-sectional view of a flat speaker unit according to another embodiment of the invention.

FIG. 2F is a cross-sectional view of a flat speaker unit according to another embodiment. In the embodiment, a flat speaker unit 200F is a cross-sectional view illustrating a double-layered flat speaker unit with the same polarity of the embodiment. As the structure of FIG. 2F is similar to that of FIG. 2B, identical components are labeled with the same numbers and thus not repeated herein. Different from the flat speaker unit 200B in FIG. 2B, getters 238, 239, 252 are disposed on sides of the resonance chambers 235, 237, and an insulating layer 250 of the flat speaker unit 200F so as to absorb moisture and maintain the space within the flat speaker unit 200F in a dry state. FIG. 2F illustrates one type of the getters, but the embodiment is not limited thereto. It should be noted that the getters in the embodiment is suitable to be disposed in all types of flat speaker structures provided in the embodiment.

Moreover, the getters are assembled by getter materials or adopt the getter materials for absorbing moisture. Therefore, the getter materials include calcium or compounds thereof, for example, or sulfur or compounds thereof.

Figure 2G:
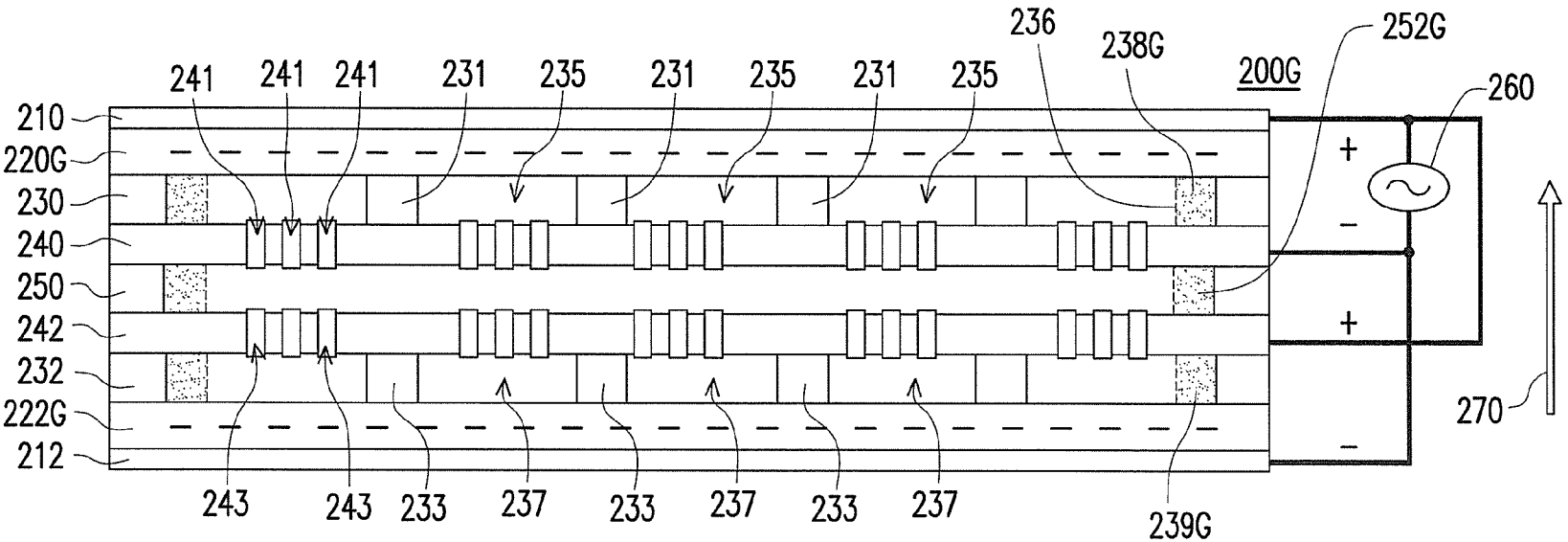
FIG. 2G is a cross-sectional view of a flat speaker unit according to another embodiment.

FIG. 2G is a cross-sectional view of a flat speaker unit according to another embodiment. In the embodiment, a flat speaker unit 200G is a cross-sectional view illustrating a double-layered flat speaker unit with the same polarity of the embodiment. As the structure of FIG. 2G is similar to that of FIG. 2F, identical components are labeled with the same numbers and thus not repeated herein. However, materials adopted for the getters are different.

In the embodiment, getters 238G, 239G, 252G on sides of the resonance chambers 235, 237 and the insulating layer 250 are filled with a moisture-absorbing powder absorbent. In addition, the getters 238G, 239G, 252G each includes a ventilation membrane 236 on a side facing the resonance chambers 235, 237 and the insulating layer 250, so that the getters 238G, 239G, 252G collect the moisture in the air to maintain the space within the flat speaker unit in a dry state.

Figure 2H:
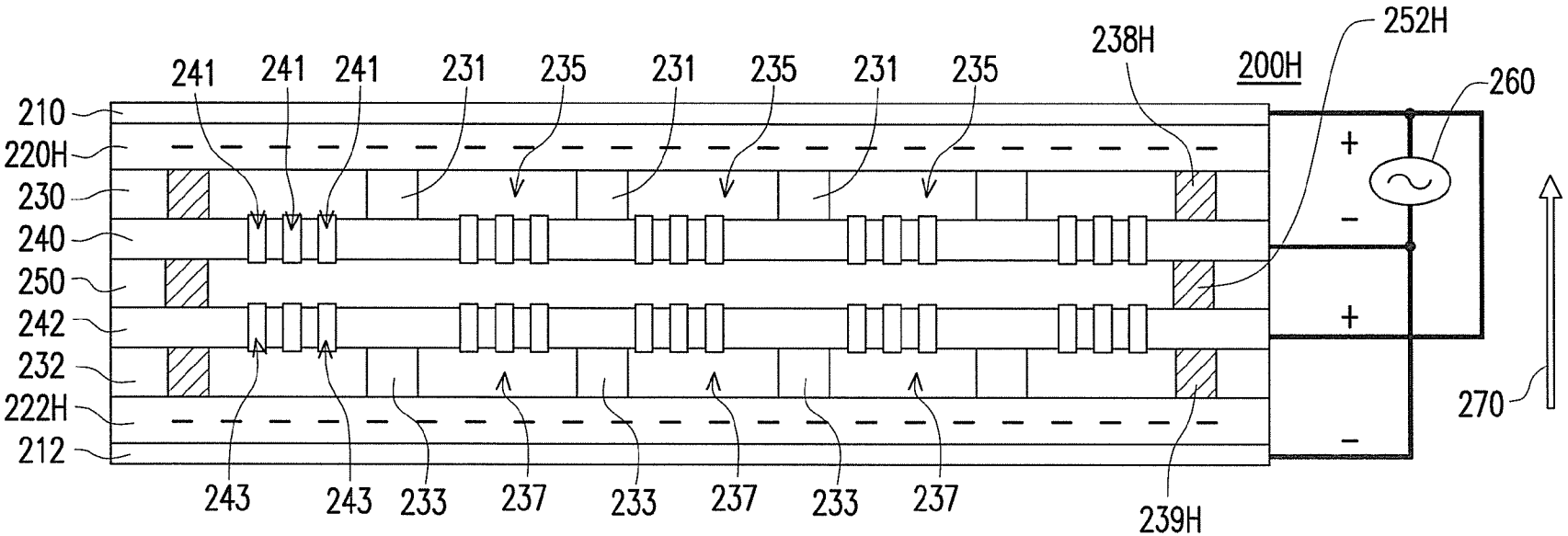
FIG. 2H is a cross-sectional view of a flat speaker unit according to another embodiment.
Figure 21:
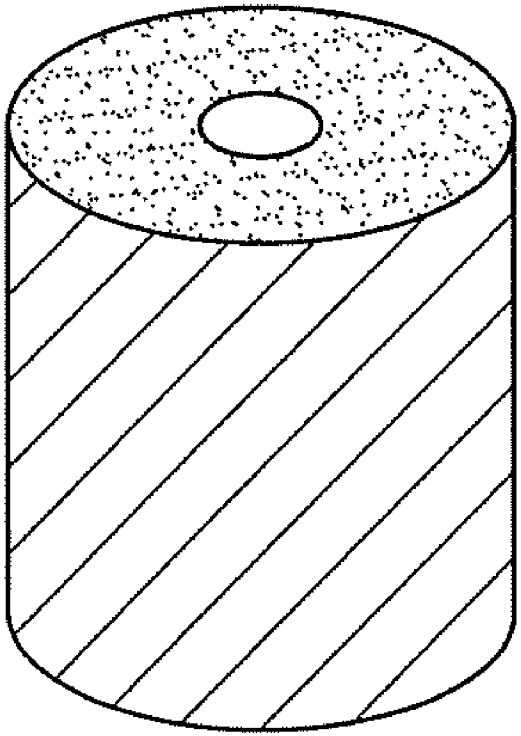
Figure 2J:
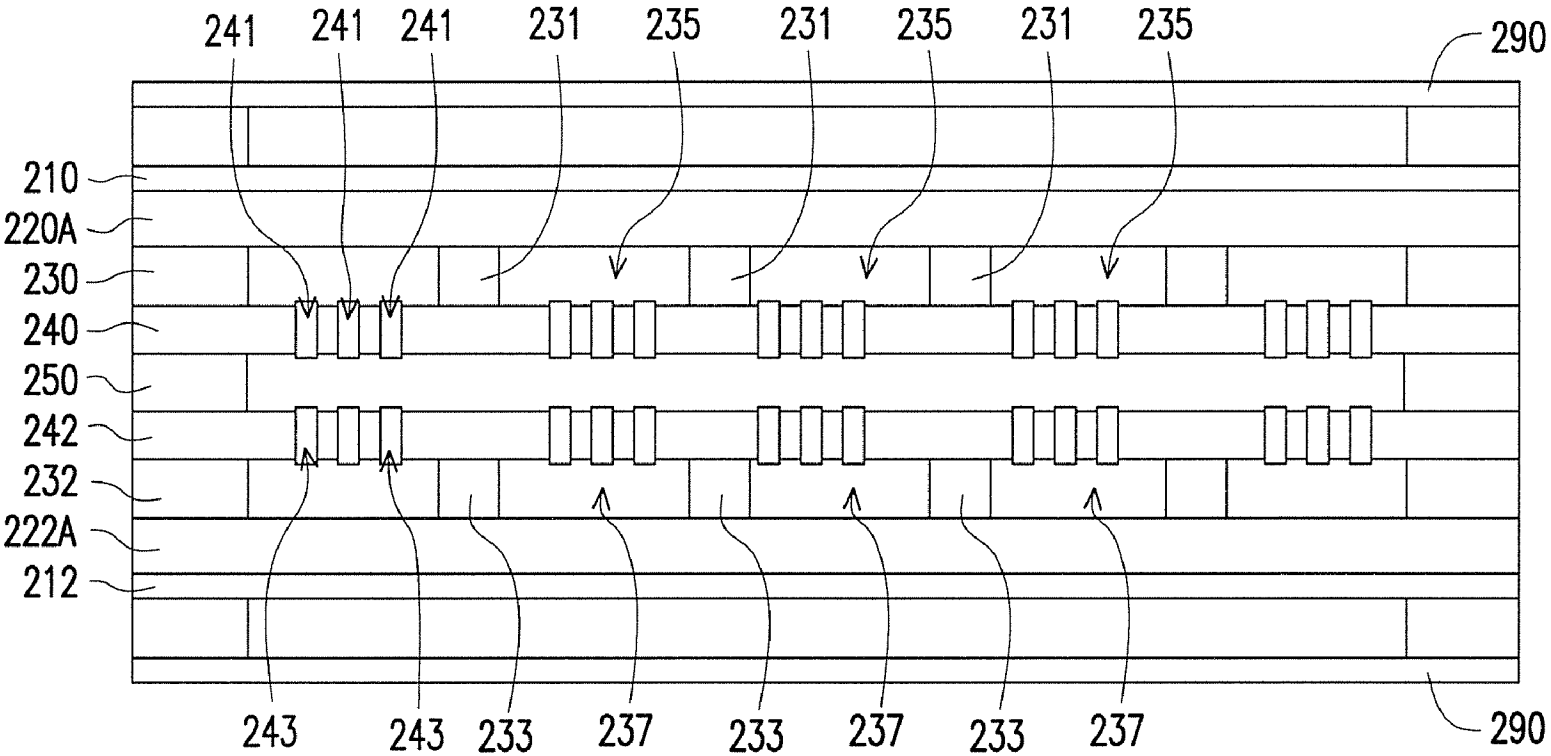
FIG. 2J is a cross-sectional view of a double-layered flat speaker with barrier layers according to an embodiment.

Next, referring to FIG. 2H, FIG. 2H is a cross-sectional view of a flat speaker unit according to another embodiment. In the embodiment, a flat speaker unit 200H is a cross-sectional view illustrating a double-layered flat speaker unit with the same polarity of the embodiment. As the structure of FIG. 2H is similar to that of FIG. 2G, identical components are labeled with the same reference numbers and thus not repeated herein. Although getters of the flat speaker unit 200G and the flat speaker unit 200H are both filled with powder absorbents, the getters 238H, 239H, 252H in the flat speaker unit 200H do not include ventilation membranes. FIG. 2I is a schematic three dimensional view of getters 238H, 239G, 252H in FIG. 2H. The getters 238H, 239G, 252H are cylinders filled with moisture absorbing absorbents. On the other hand, the flat speaker unit 200H collects the moisture in the air via pores above the getters 238H, 239G, 252H for maintaining the flat speaker unit 200H at the dry state. FIG. 2H illustrates one type of the getters, but the embodiment is not limited thereto. FIG. 2J is a cross-sectional view of a double-layered flat speaker with barrier layers according to an embodiment. As the structure of FIG. 2J is similar to that of FIG. 2A, identical components are labeled with the same numbers and thus not repeated herein. FIG. 2J is different from FIG. 2A in that two barrier layers 290 with moisture blockage effects are disposed on the external sides of the flat speaker unit to further improve the reliability and lifetime of the flat speaker unit.

Double Layered Flat Speaker Unit Using a Common Electrode Layer

Figure 3A:
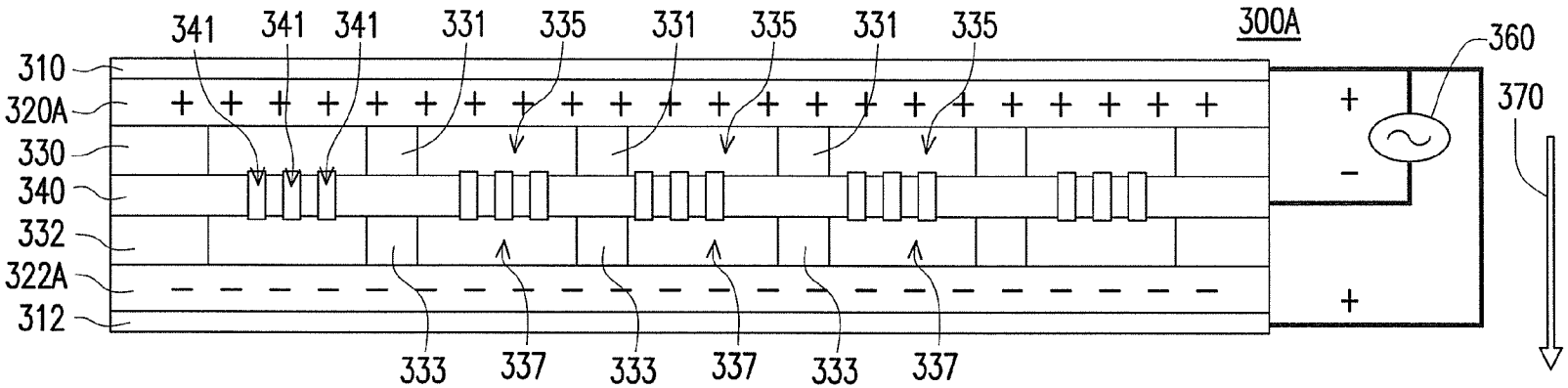
FIG. 3A and FIG. 3B are schematic cross-sectional views of a flat speaker unit assembled by stacking an upper and a lower vibrating membrane structures and a common electrode structure according to an embodiment.
Figure 3B:
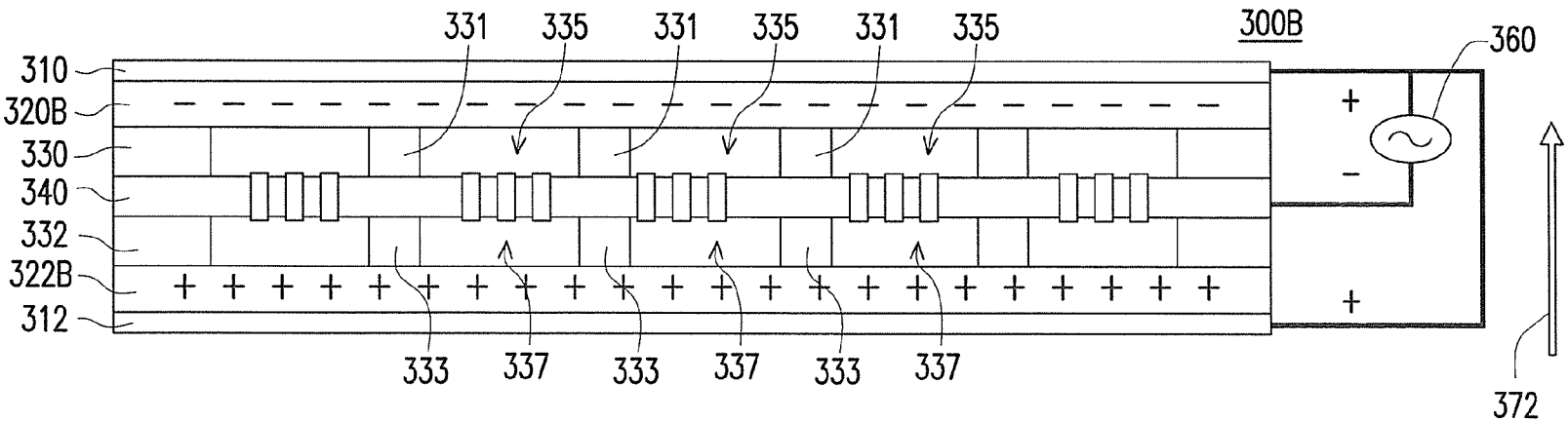

A reliable flat speaker structure is provided in the embodiment. The same set of signals is used to drive a plurality of flat speaker units. This method effectively enhances the sound-producing efficiency of the flat speaker to achieve the required sound-pressure specification in the application design of the flat speaker. In the embodiment, stacked flat speaker units share a common electrode layer so that sounds of different frequencies or sound volumes are generated by the upper and lower vibrating membranes according to the phase-alternating audio signals provided by the signal source. FIG. 3A and FIG. 3B are referred to for further illustration.

Firstly, referring to FIG. 3A, a flat speaker unit 300A of the embodiment is stacked by an upper and a lower vibrating structures and a common electrode structure. The vibrating membrane structure is assembled by a moisture blocking conductive layer and a vibrating membrane, such as a metal electrode 310 and a vibrating membrane 320A of the upper layer and a metal electrode 312 and a vibrating membrane 322A of the lower layer as illustrated in the diagram. The common electrode structure is an electrode 340 having a plurality of sound holes 341 as illustrated in the diagram, and is used to facilitate the air flow between resonance chambers. In addition, supporting member layers are optionally disposed between the vibrating membrane structures and the electrode structure to form resonance chambers configured by the vibrating membranes to produce sounds. Examples of the supporting member layers include a supporting member layer 330 between the vibrating membrane 320A and the electrode 340 or a supporting member layer 332 between the vibrating membrane 322A and the electrode 340. The supporting member layer 330 has a plurality of supporting members 331, which are arranged in different patterns. The supporting member layer 332 has a plurality of supporting members 333, which are arranged in different patterns. As a result, resonance chambers 335 and 337 are formed respectively as illustrated in the diagram.

The pattern structure of the supporting member layer can solve the possible electrostatic effect generated between the vibrating membranes and the electrodes in the flat speaker structure. The layout of the supporting members is arranged into geometrical configurations according to the electrostatic effect of the vibrating membrane as illustrated in the foregoing embodiment, and is not repeated herein.

In the embodiment, the vibrating membranes 320A and 322A of the flat speaker unit 300 carry positive and negative charges respectively. The structure of the double-layered flat speaker unit with opposite polarities provided in the embodiment is represented herein. A signal source 360 configured to provide the audio signals is connected to the flat speaker unit 300A as illustrated in FIG. 3A. One end of the signal source 360 is connected to the metal electrode 310 of the vibrating membrane 320A and the metal electrode 312 of the vibrating membrane 322A simultaneously. The other end of the signal source 360 is connected to the common electrode 340.

When the positive voltage of the signal source 360 is delivered to the metal electrode 310, a repulsive force is generated between the positive voltage on the metal electrode 310 and the positive charges on the vibrating membrane 320A. Moreover, when the negative voltage of the signal source 360 is delivered to the electrode 340, an attractive force is generated between the negative voltage of the electrode 340 and the positive charges on the vibrating membrane 320A. Therefore, the vibrating membrane 320A bends toward and compresses the resonance chamber 335. In addition, when the negative voltage of the signal source 360 is delivered to the metal electrode 340, a repulsive force is generated between the negative voltage on the metal electrode 340 and the negative charges on the vibrating membrane 322A. Moreover, the positive voltage of the signal source 360 is delivered to the metal electrode 312, and an attractive force is generated between the positive voltage of the metal electrode 312 and the negative charges on the vibrating membrane 322A. Therefore, the vibrating membrane 322A bends away from and expands the resonance chamber 337. Thus, the forced direction of the vibrating membranes is as that shown by a reference number 370.

FIG. 3A illustrates one of the voltage-phases of the audio signals of the signal source 360, but the embodiment is not limited thereto. For instance, when the voltage-phase input of the source signal 360 has changed, the negative voltage of the source signal 360 is delivered to the metal electrodes 310 and 312, and the positive voltage is delivered to the electrode 340, then the forced direction of the vibrating membranes is opposite to that as shown by the reference number 370. The phase-alternating audio signals provided by the signal source 360 allows the flat speaker unit 300A to produce sounds of different frequencies or sound volumes through the different forced directions of the vibrating membranes.

In another embodiment, referring to FIG. 3B, a flat speaker unit 300B is a cross-sectional view illustrating a double-layered flat speaker unit with opposite polarity according to the embodiment. As the structure of FIG. 3B is similar to that of FIG. 3A, identical components are labeled with the same numbers and thus not repeated herein. FIG. 3B is different from FIG. 3A in that a vibrating membrane 320B carries negative charges and a vibrating membrane 322B carries positive charges. The structure of the double-layered flat speaker unit with opposite polarities provided in the embodiment is represented herein. The signal source 360 configured to provide the audio signals is connected to the flat speaker unit 300B as illustrated in FIG. 3B. One end of the signal source 360 is connected to the metal electrode 310 of the vibrating membrane 320B and the metal electrode 312 of the vibrating membrane 322B simultaneously. The other end of the signal source 360 is connected to the common electrode 340.

When the positive voltage of the signal source 360 is delivered to the metal electrode 310, an attractive force is generated between the positive voltage on the metal electrode 310 and the negative charges on the vibrating membrane 320B. Moreover, when the negative voltage of the signal source 360 is delivered to the electrode 340, a repulsive force is generated between the negative voltage of the electrode 340 and the negative charges on the vibrating membrane 320B. Therefore, the vibrating membrane 320B bends away from and expands the resonance chamber 335. In addition, when the negative voltage of the signal source 360 is delivered to the electrode 340, an attractive force is generated between the negative voltage on the electrode 340 and the positive charges on the vibrating membrane 322B. Moreover, the positive voltage of the signal source 360 is delivered to the metal electrode 312, a repulsive force is generated between the positive voltage of the metal electrode 312 and the positive charges on the vibrating membrane 322B. Therefore, the vibrating membrane 322B bends toward and compresses the resonance chamber 337. Thus, the forced direction of the vibrating membranes is as that shown by a reference number 372.

Figure 3C:
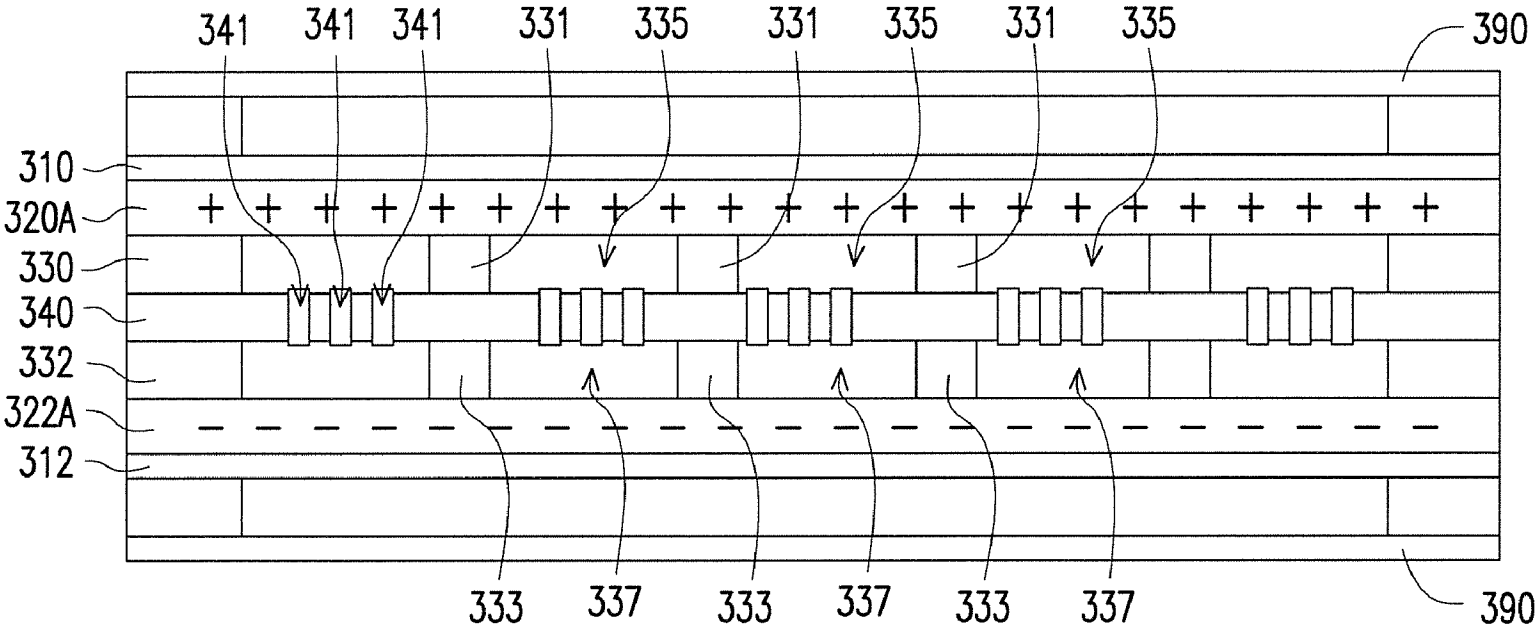
FIG. 3C is schematic cross-sectional views of a flat speaker unit with barrier layers according to an embodiment.

FIG. 3B illustrates one of the voltage-phases of the audio signals of the signal source 360, but the embodiment is not limited thereto. For instance, when the voltage-phase input of the source signal 360 has changed, the negative voltage of the source signal 360 is delivered to the metal electrodes 310 and 312, and the positive voltage is delivered to the electrode 340, then the forced direction of the vibrating membranes is opposite to that as shown by the reference number 372. The phase-alternating audio signals provided by the signal source 360 allows the flat speaker unit 300B to produce sounds of different frequencies or sound volumes through the different forced directions of the vibrating membranes. FIG. 3C is schematic cross-sectional views of a flat speaker unit with barrier layers according to an embodiment. As the structure of FIG. 3C is similar to that of FIG. 3A, identical components are labeled with the same numbers and thus not repeated herein. FIG. 3C is different from FIG. 3A in that two barrier layers 390 with moisture blockage effects are disposed on the external sides of the flat speaker unit to further improve the reliability and lifetime of the flat speaker unit.

Speaker Device Stacked by a Plurality of Flat Speaker Units

In a reliable speaker device provided in the embodiment the flat speaker units aforementioned in the foregoing embodiments are assembled into different combinations, such that a plurality of flat speaker units is driven to produce sounds by adjusting the positive polarity or negative polarity of the terminal without changing the design of the input signal source.

In the following, a speaker device stacked by a plurality of reliable speaker unit structures provided in the embodiment is illustrated in different embodiments.

Figure 4A:
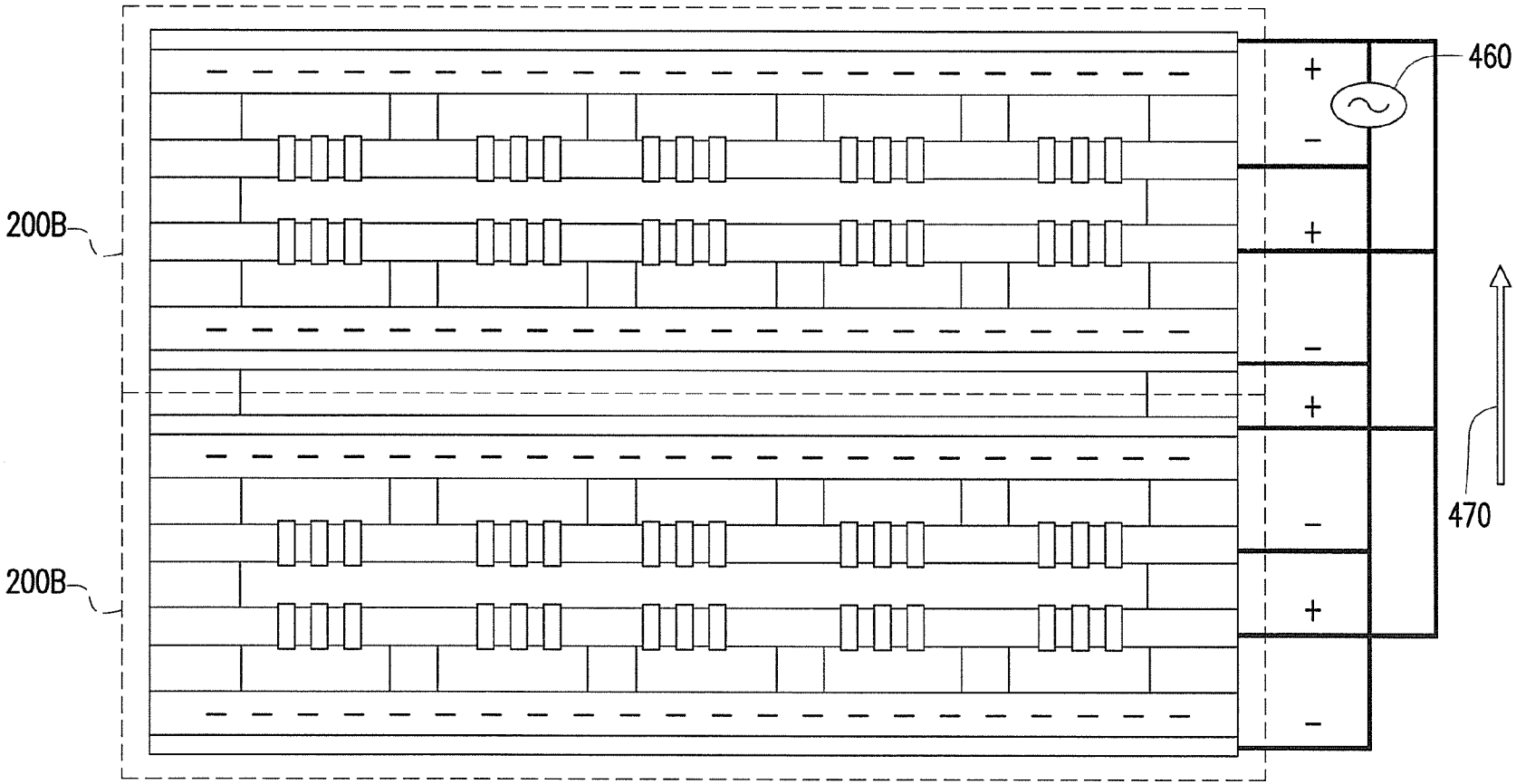

Referring to FIG. 4A, the embodiment applies the flat speaker unit 200B in FIG. 2B, which is a double-layered flat speaker unit with the same polarity. In the embodiment, at least two flat speaker units 200B are stacked together and an insulating layer is disposed therebetween for isolation. As illustrated in the diagram, a forced direction of a reference number 470 can be attained by the method of connecting positive/negative signals of a signal source 460. On the contrary, when the voltage-phase input of the source signal 460 has changed, a forced direction that is opposite to the reference number 470 is achieved. In other words, the phase-alternating audio signals provided by the signal source 460 allows the speaker device to produce sounds of different frequencies or sound volumes through the different forced directions of the vibrating membranes.

Figure 4B:
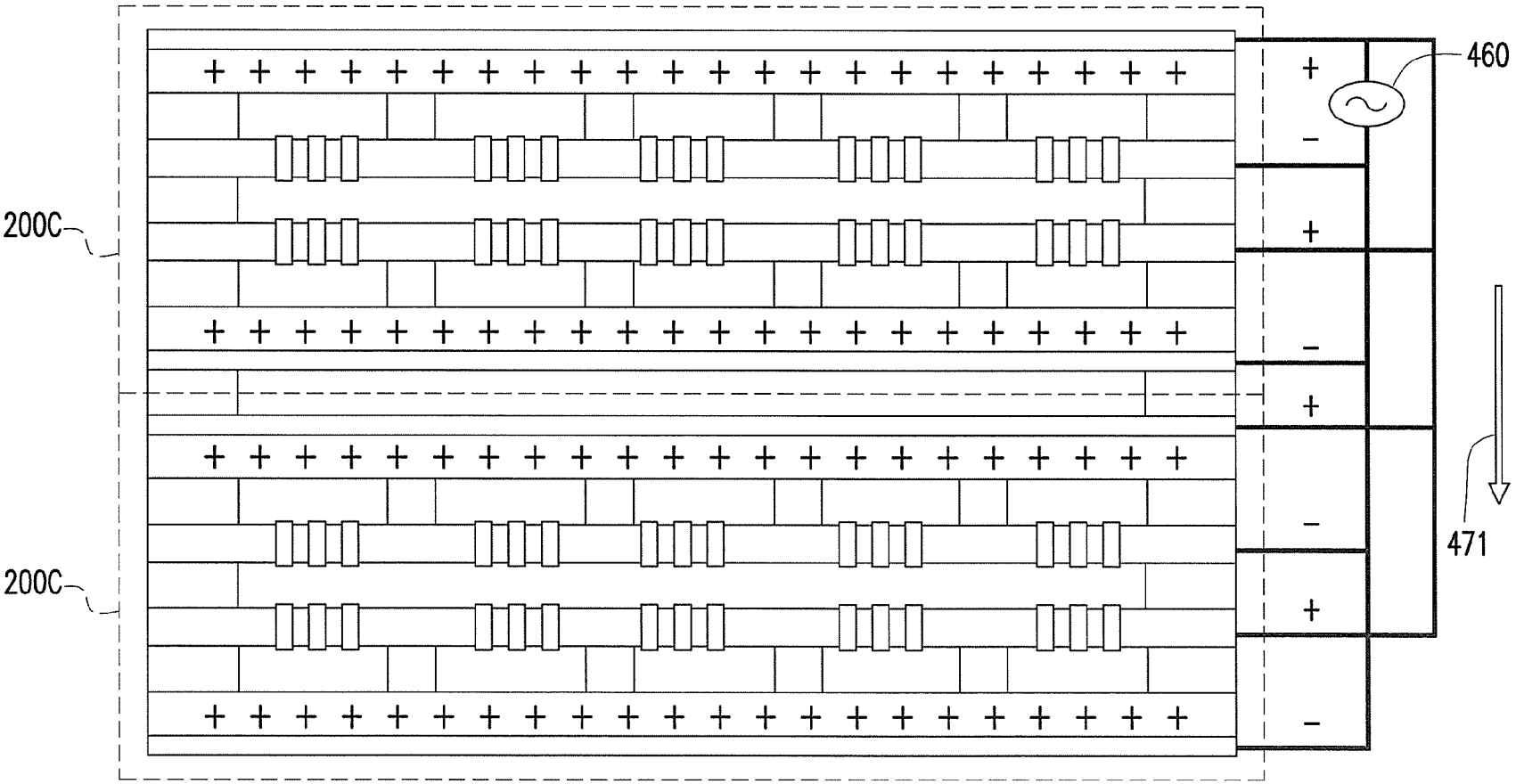

Referring to FIG. 4B, the embodiment applies the flat speaker unit 200C in FIG. 2C, which is a double-layered flat speaker unit with the same polarity. In the embodiment, at least two flat speaker units 200C are stacked together and an insulating layer is disposed therebetween for isolation. As illustrated in the diagram, a forced direction of a reference number 471 can be attained by the method of connecting positive/negative signals of a signal source 460. On the contrary, when the voltage-phase input of the source signal 460 has changed, a forced direction that is opposite to the reference number 471 is achieved. In other words, the phase-alternating audio signals provided by the signal source 460 allows the speaker device to produce sounds of different frequencies or sound volumes through the different forced directions of the vibrating membranes.

Figure 4C:
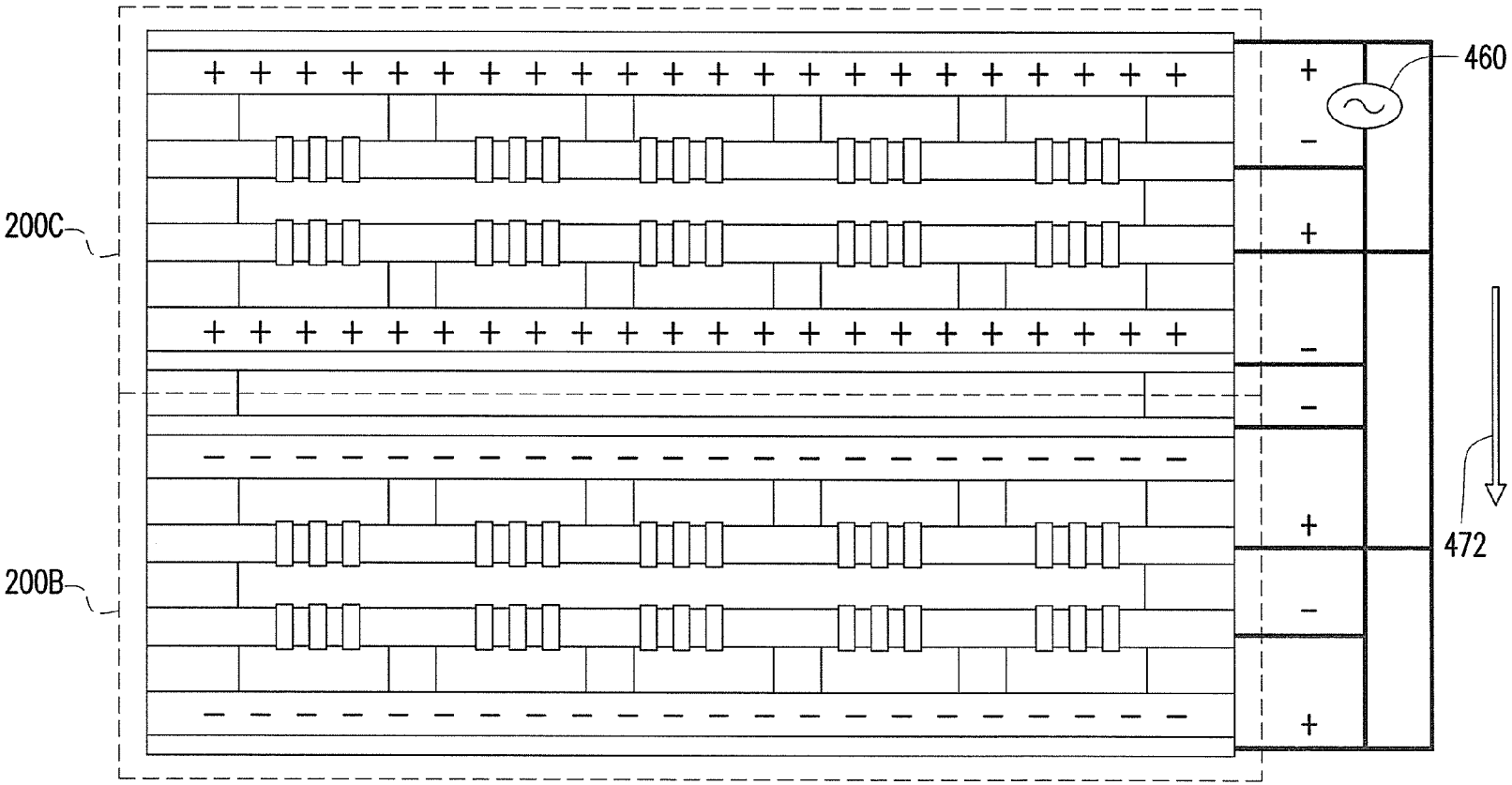

Referring to FIG. 4C, the embodiment applies the flat speaker unit 200B of FIG. 2B in corporation with the flat speaker unit 200C of FIG. 2C. That is, in the embodiment, two types of double-layered flat speaker units each with the same polarity are stacked together and an insulating layer is disposed therebetween for isolation. As illustrated in the diagram, a forced direction of a reference number 472 can be attained by the method of connecting positive/negative signals of a signal source 460. On the contrary, when the voltage-phase input of the source signal 460 has changed, a forced direction that is opposite to the reference number 472 is achieved. In other words, the phase-alternating audio signals provided by the signal source 460 allows the speaker device to produce sounds of different frequencies or sound volumes through the different forced directions of the vibrating membranes.

Figure 4D:
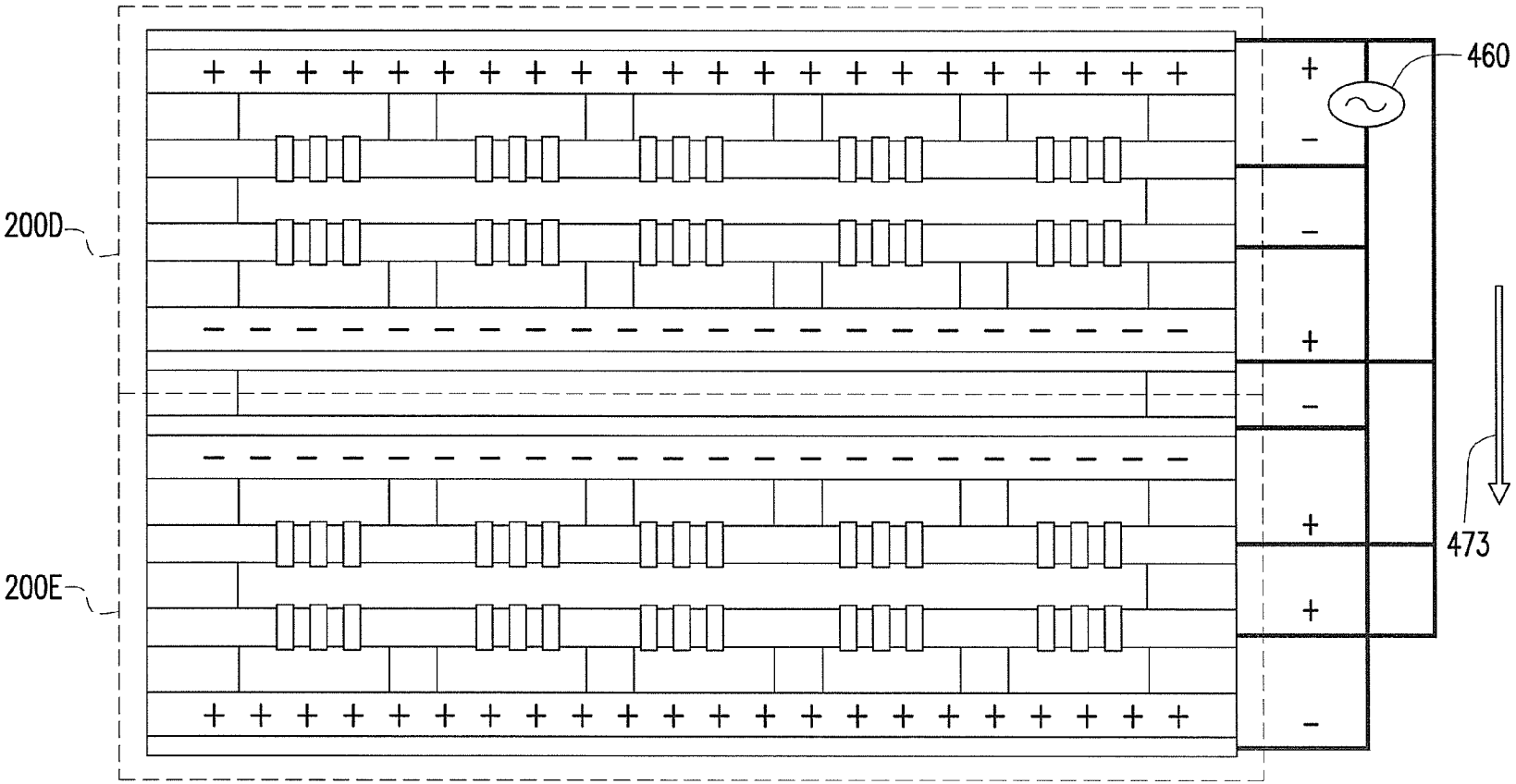

Referring to FIG. 4D, the embodiment applies the flat speaker unit 200D of FIG. 2D in corporation with the flat speaker unit 200E of FIG. 2E. That is, in the embodiment, two types of double-layered flat speaker units each with opposite polarities are stacked together and an insulating layer is disposed therebetween for isolation. As illustrated in the diagram, a forced direction of a reference number 473 can be attained by the method of connecting positive/negative signals of a signal source 460. On the contrary, when the voltage-phase input of the source signal 460 has changed, a forced direction that is opposite to the reference number 473 is achieved. In other words, the phase-alternating audio signals provided by the signal source 460 allows the speaker device to produce sounds of different frequencies or sound volumes through the different forced directions of the vibrating membranes.

Figure 4E:
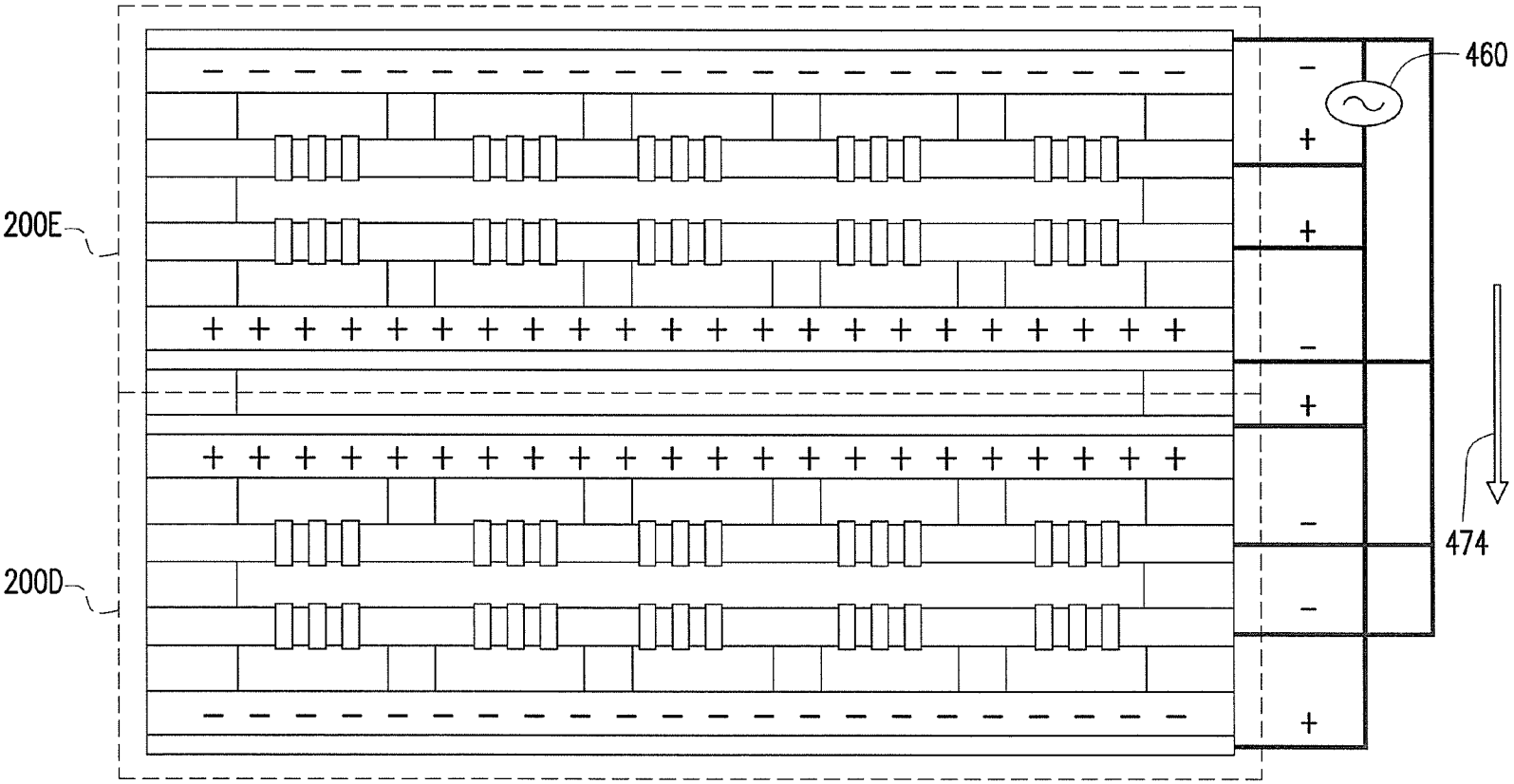

In FIG. 4E, the stacked positions of the flat speaker unit 200D and the flat speaker unit 200E are interchanged. As illustrated in the diagram, a forced direction of a reference number 474 can be attained by the method of connecting positive/negative signals of a signal source 460. On the contrary, when the voltage-phase input of the source signal 460 has changed, a forced direction that is opposite to the reference number 474 is achieved. In other words, the phase-alternating audio signals provided by the signal source 460 allows the speaker device to produce sounds of different frequencies or sound volumes through the different forced directions of the vibrating membranes.

Based on the arranging methods aforementioned, the sound-pressure specification required for product application is provided. The flat speaker units aforementioned are assembled into various combinations without increasing the complexity of the circuit design. For example, in the foregoing concept, the electret charges of the flat speaker units are collocated according to the odd/even polarities thereof. Subsequently, the set of external audio signals is provided in corporation with the audio signal input design to enhance the sound volume output. It should be noted that the embodiments described in FIGS. 4A-4E are some examples of application. To the reliable speaker device provided in the embodiment, various combinations can be assembled with the flat speaker units provided in the foregoing embodiments, the combination designs of multiple speaker units are unlimited and all belong within the scope of the embodiment.

Blanket Layer of Insulating Layer

In the unit structure of the double-layered flat speaker aforementioned, a blanket layer of insulating layer can be disposed between the upper and the lower electrodes. Moreover, the blanket layer includes a plurality of sound holes which penetrates the stacked structure of the upper and lower electrodes and the insulating layer. The above-mentioned structure also belongs within the scope of the embodiment. Although only one embodiment is used for illustration in the following, the embodiment is not limited thereto. Following the foregoing concept, the electret charges of the flat speaker units are collocated according to the odd/even polarities thereof. Subsequently, the external audio signals are provided in corporation with the audio signal input design to enhance the sound volume output.

Figure 5:
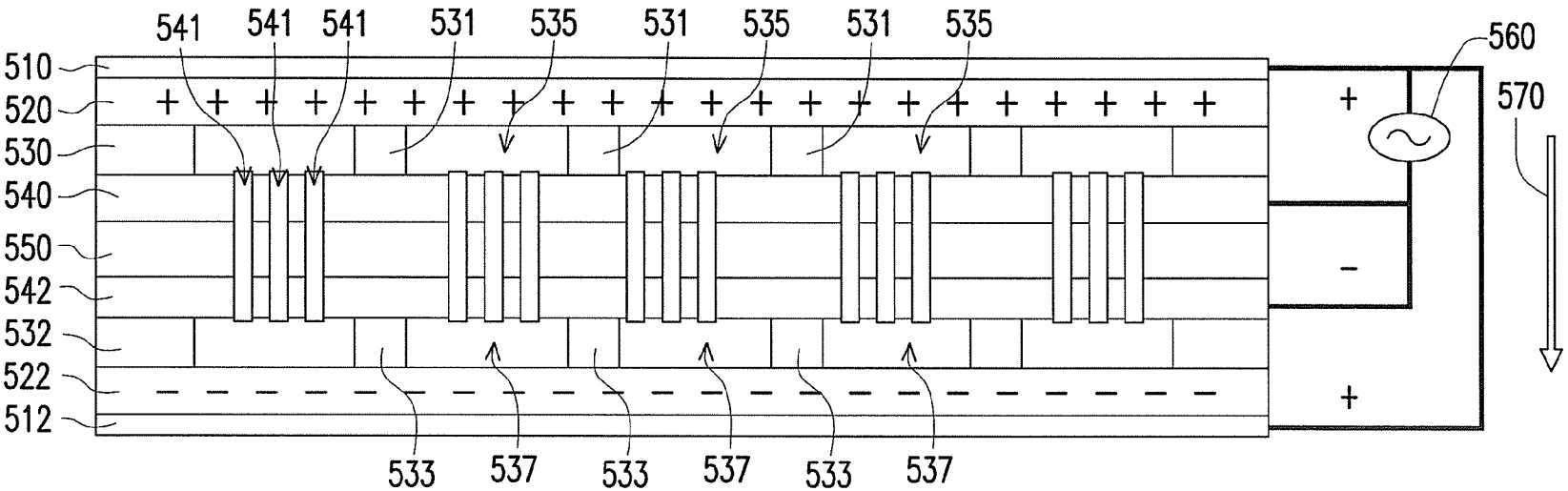
FIG. 5 is a schematic cross-sectional view illustrating a flat speaker unit structure of a double-layered flat speaker with opposite polarities according to another embodiment.

FIG. 5 is a schematic cross-sectional view illustrating a structure of a double-layered flat speaker unit with opposite polarities according to another embodiment. This flat speaker unit is constituted by stacking an upper and a lower vibrating membrane structures and electrode structures. Moreover, an insulating layer is disposed in-between for electrical isolation. The vibrating membrane structure is assembled by a moisture blocking conductive layer and a vibrating membrane, such as a metal electrode 510 and a vibrating membrane 520 of the upper layer and a metal electrode 512 and a vibrating membrane 522 of the lower layer. Each vibrating membrane structure has a corresponding electrode structure, such as an electrode 540 and facing the vibrating membrane 520 and an electrode 542 and facing the vibrating membrane 522. In addition, supporting member layers are optionally disposed between each vibrating membrane structure and the corresponding electrode structure thereof to form a resonance chamber configured by the vibrating membrane to produce sounds. Examples of the supporting member layers include supporting member layers 530 and 532. The supporting member layer 530 has a plurality of supporting members 531, which are arranged in different patterns. The supporting member layer 532 has a plurality of supporting members 533, which are arranged in different patterns. As a result, resonance chambers 535 and 537 are formed respectively as illustrated in the diagram. A signal source 560, which provides audio signals, has a connecting method as illustrated in FIG. 5. One end of the signal source 560 is connected to metal electrodes 510 and 512 simultaneously, and the other end is connected to electrodes 540 and 542 simultaneously.

Figure 5A:
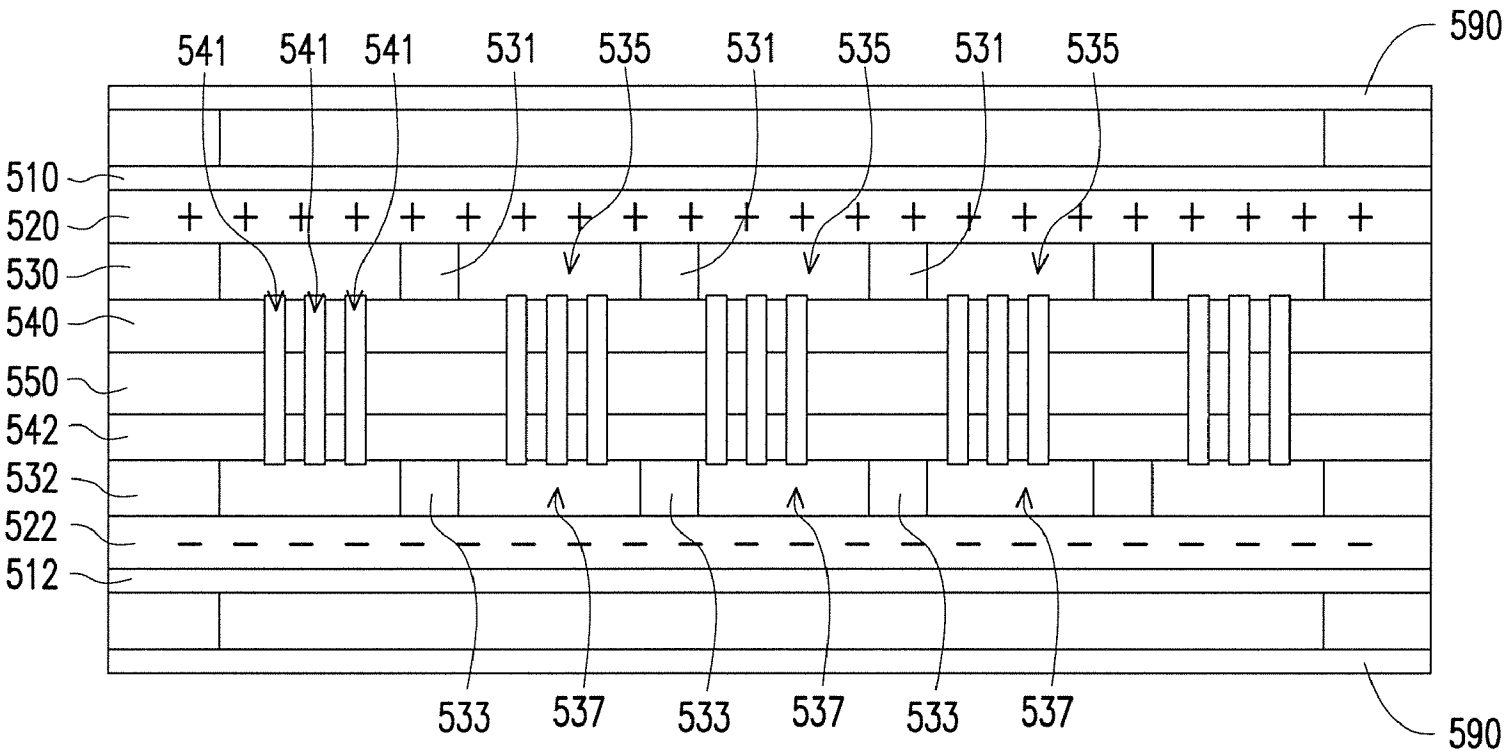
FIG. 5A is a schematic cross-sectional view illustrating a flat speaker unit structure of a double-layered flat speaker with barrier layers.

The embodiment is different from the foregoing embodiments in that an insulating layer 550 disposed between the electrodes 540 and 542 is a blanket layer of insulating layer. Furthermore, sound holes 541 penetrating the electrode 540, the insulating layer 550, and the electrode 542 also belong within the application of the double-layered flat speaker unit structure provided in the embodiment. FIG. 5A is schematic cross-sectional views of a flat speaker unit with barrier layers according to an embodiment. As the structure of FIG. 5A is similar to that of FIG. 5, identical components are labeled with the same numbers and thus not repeated herein. FIG. 5A is different from FIG. 5 in that two barrier layers 590 with moisture blockage effects are disposed on the external sides of the flat speaker unit to further improve the reliability and lifetime of the flat speaker unit.

In summary, the flat speaker of the embodiment utilizes the moisture isolating characteristics of the electret vibrating membranes and the metal electrodes thereof. The metal electrode layers are assembled by a metal, a plurality of metal combinations (alloys), metal electrodes or polymers. The metal electrodes are disposed on the utmost sides of the flat speaker unit to improve the reliability of the flat speaker unit. In addition, the electret vibrating membranes in the flat speaker are deformed when applied with an audio signal voltage, so as to drive the surrounding air to produce sound. At the same time, in another embodiment, a combination of a plurality of flat speaker units is performed to increase the sound-pressure output. Thus, the conventional method of disposing barrier layers on the external sides of the speaker unit is omitted. The circuit in the embodiment also solves the complexity in the structure and circuit of the flat speaker when increasing sound-pressure power.

Although the exemplary embodiment has been described with reference to drawings, it will be apparent to one of the ordinary skill in the art that modifications to the described exemplary embodiment may be made without departing from the spirit of the invention. Accordingly, the scope of the invention will be defined by the attached claims not by the above detailed descriptions.

What is claimed is:

1. A flat speaker unit, comprising:

a first vibrating membrane, having a first surface and a second surface, the first surface disposed with a first conductive electrode for blocking moisture;

a second vibrating membrane, having a first surface and a second surface, the first surface disposed with a second conductive electrode for blocking moisture;

an electrode structure, disposed between the second surface of the first vibrating membrane and the second surface of the second vibrating membrane;

a first supporting member layer, disposed between the first vibrating membrane and the electrode structure; and a second supporting member layer, disposed between the second vibrating membrane and the electrode structure, wherein the first vibrating membrane, the first supporting member layer, the electrode structure, the second supporting member layer, and the second vibrating membrane stack into a stacked structure, and the first conductive electrode and the second conductive electrode are placed on opposite outer-sides of the stacked structure to form a resonance chamber within the stacked structure.

2. The flat speaker unit as claimed in claim 1, further comprising an insulating layer, disposed between a first electrode and a second electrode of the electrode structure for an electrical isolation, wherein the first electrode and the second electrode have a plurality of sound holes.

3. The flat speaker unit as claimed in claim 2, wherein the insulating layer is a blanket-layer structure and stacks into the whole electrode structure with the first electrode and the second electrode, and the plurality of sound holes penetrates through the electrode structure.

4. The flat speaker unit as claimed in claim 3, wherein the first conductive electrode, the first vibrating membrane, the first supporting member layer, and the first electrode stack into a first unit structure, and the second conductive electrode, the second vibrating membrane, the second supporting member layer, and the second electrode stack into a second unit structure, so that the resonance chamber formed within the first unit structure is connected with the second unit structure via the plurality of sound holes that penetrated the electrode structure.

5. The flat speaker unit as claimed in claim 2, wherein the first conductive electrode, the first vibrating membrane, the first supporting member layer, and the first electrode stack into a first unit structure, and the second conductive electrode, the second vibrating membrane, the second supporting member layer, and the second electrode stack into a second unit structure, so that a resonance chamber formed within the first unit structure is connected with the second unit structure via the plurality of sound holes of the first electrode and the plurality of sound holes of the second electrode.

6. The flat speaker unit as claimed in claim 2, wherein the first vibrating membrane and the second vibrating membrane are electret vibrating membranes, such that the first vibrating membrane and the second vibrating membrane are vibrated by adjusting audio signals of different polarities to the first conductive electrode and the first electrode and to the second conductive electrode and the second electrode, thereby the flat speaker unit produces sounds with different frequencies.

7. The flat speaker unit as claimed in claim 6, wherein when the first vibrating membrane and the second vibrating membrane are charged with charges of the same polarity, the first conductive electrode and the second electrode are connected to an audio signal of a first polarity and the second conductive electrode and the first electrode are connected to an audio signal of a second polarity, wherein the first polarity and the second polarity have opposite electric phase.

8. The flat speaker unit as claimed in claim 6, wherein when the first vibrating membrane and the second vibrating membrane are charged with charges of opposite polarities, the first conductive electrode and the second conductive electrode are connected to the audio signal of the first polarity and the first electrode and the second electrode are connected to the audio signal of the second polarity, wherein the first polarity and the second polarity have opposite electric phase.

9. The flat speaker unit as claimed in claim 1, the electrode structure comprising an electrode, wherein the electrode comprises a plurality of sound holes.

10. The flat speaker unit as claimed in claim 9, wherein the first conductive electrode, the first vibrating membrane, the first supporting member layer, and the electrode stack into a first unit structure, and the second conductive electrode, the second vibrating membrane, the second supporting member layer, and the electrode stack into a second unit structure, wherein the first unit structure and the second unit structure share the electrode and a resonance chamber formed within the first unit structure is connected with the second unit structure via the plurality of sound holes of the electrode.

11. The flat speaker unit as claimed in claim 10, wherein the first vibrating membrane and the second vibrating membrane are electret vibrating membranes, such that the first vibrating membrane and the second vibrating membrane are vibrated to produce sounds of different frequencies by adjusting audio signals of different polarities to the first conductive electrode, the electrode, and the second conductive electrode.

12. The flat speaker unit as claimed in claim 11, wherein when the first vibrating membrane and the second vibrating membrane are charged with charges of opposite polarities, the first conductive electrode and the second conductive electrode are connected to the audio signal of the first polarity and the electrode is connected to the audio signal of the second polarity, wherein the first polarity and the second polarity have opposite electric phase.

13. The flat speaker unit as claimed in claim 1, wherein the first supporting member layer and the second supporting member layer have a first layout pattern and a second layout pattern respectively, wherein the first layout pattern and the second layout pattern are adjusted according to an electrostatic effect of the first vibrating membrane and the electrode structure and the second vibrating membrane and the electrode structure.

14. The flat speaker unit as claimed in claim 13, wherein the first supporting member layer and the second supporting member layer respectively have a plurality of supporting members disposed therebetween to form the first layout pattern and the second layout pattern.

15. The flat speaker unit as claimed in claim 14, wherein the first layout pattern and the second layout pattern are constituted by a configuration or a disposition location of the plurality of supporting members.

16. The flat speaker unit as claimed in claim 15, wherein the configuration of the plurality of supporting members comprises one of the following shapes: dot-shaped, grid-shaped, cross-shaped, trigonal prism-shaped, cylindrical-shaped, or rectangular-shaped.

17. The flat speaker unit as claimed in claim 1, wherein the flat speaker unit is connected to a signal source which provides audio signals of different polarities to the electrode structure, the first conductive electrode, and the second conductive electrode respectively to vibrate the first vibrating membrane and the second vibrating membrane, thereby the flat speaker unit produces sounds with different frequencies.

18. The flat speaker unit as claimed in claim 1, wherein the first vibrating membrane and the second vibrating membrane are electret vibrating membranes, and a material thereof is a electret piezoelectric composite material with micro order or nano order pores.

19. The flat speaker unit as claimed in claim 1, wherein the micro/nano nanopore electret piezoelectric composite material is selected from a material group consisting of fluorinated ethylenepropylene (FEPP), tetrafluoethylene (TFE), polyvinylidene fluoride (PVDF), compounds having carbon-carbon double bonds, and partial-fluorine-containing polymers.

20. The flat speaker unit as claimed in claim 1, wherein the first conductive electrode and the second conductive electrode are selected from a group consisting of conductive metal thin membrane, silver glue, indium tin oxide (ITO), indium zinc oxide (IZO), and polyethylene dioxythiophene (PEDOT).

21. The flat speaker unit as claimed in claim 1, wherein the first conductive electrode and the second conductive electrode are constituted by metals, a plurality of metal combinations (alloys), or metal electrodes and polymers.

22. The flat speaker unit as claimed in claim 1, further comprising at least a getter, disposed within the resonance chamber for absorbing moisture therein.

23. The flat speaker unit as claimed in claim 22, wherein the getter is a physical getter or a chemical getter.

24. The flat speaker unit as claimed in claim 23, wherein the getter is an evaporation getter or a non-evaporation getter.

25. A speaker device, stacked by a plurality of flat speaker units, wherein each of the plurality of flat speaker units comprises:

a first vibrating membrane, having a first surface and a second surface, the first surface disposed with a first conductive electrode for blocking moisture;

a second vibrating membrane, having a third surface and a forth surface, the third surface disposed with a second conductive electrode for blocking moisture;

an electrode structure, disposed between the second surface of the first vibrating membrane and the forth surface of the second vibrating membrane;

a first supporting member layer, disposed between the first vibrating membrane and the electrode structure; and a second supporting member layer, disposed between the first vibrating membrane and the electrode structure and between the second vibrating membrane and the electrode structure, wherein the first vibrating membrane, the first supporting member layer, the electrode structure, the second supporting member layer, and the second vibrating member stack into a stacked structure, and the first conductive electrode and the second conductive electrode are placed on opposite outer-most sides of the stacked structure to form a resonance chamber within the stacked structure.

26. The speaker device as claimed in claim 25, wherein the plurality of flat speaker units at least stacks into a two-layer structure.

27. The speaker device as claimed in claim 25, wherein at least one of the plurality of flat speaker units comprises an insulating layer, which is disposed between a first electrode and a second electrode of the electrode structure for an electrical isolation, and the first electrode and the second electrode have a plurality of sound holes.

28. The speaker device as claimed in claim 27, wherein the insulating layer of at least one of the plurality of flat speaker units is a blanket-layer structure and stacks into the whole electrode structure with the first electrode and the second electrode, and the plurality of sound holes penetrates through the electrode structure.

29. The speaker device as claimed in claim 27, wherein in at least one of the plurality of flat speaker units, the first conductive electrode, the first vibrating membrane, the first supporting member layer, and the first electrode stack into a first unit structure, and the second conductive electrode, the second vibrating membrane, the second supporting member layer, and the second electrode stack into a second unit structure, so that a resonance chamber formed within the first unit structure is connected with the second unit structure via the plurality of sound holes of the first electrode and the plurality of sound holes of the second electrode.

30. The speaker device as claimed in claim 27, wherein in at least one of the plurality of flat speaker units, the first vibrating membrane and the second vibrating membrane are electret vibrating membranes by adjusting audio signals of different polarities to the first conductive electrode and the first electrode and to the second conductive electrode and the second electrode, thereby the speaker device produces sounds with different frequencies.

31. The speaker device as claimed in claim 25, wherein in at least one of the plurality of flat speaker units, the electrode structure comprises an electrode having a plurality of sound holes.

32. The speaker device as claimed in claim 31, wherein in at least one of the plurality of flat speaker units, the first conductive electrode, the first vibrating membrane, the first supporting member layer, and the first electrode stack into a first unit structure, and the second conductive electrode, the second vibrating membrane, the second supporting member layer, and the second electrode stack into a second unit structure, so that a resonance chamber formed within the first unit structure is connected with the second unit structure via the plurality of sound holes of the first electrode and the plurality of sound holes of the second electrode.

33. The speaker device as claimed in claim 25, wherein in at least one of the flat speaker units, the first supporting member layer and the second supporting member layer have a first layout pattern and a second layout pattern respectively, and the first layout pattern and the second layout pattern are respectively adjusted according to an electrostatic effect of the first vibrating membrane and the electrode structure and the second vibrating membrane and the electrode structure.

34. The speaker device as claimed in claim 33, wherein in at least one of the flat speaker units, the first supporting member layer and the second supporting member layer respectively have a plurality of supporting members disposed therebetween to form the first layout pattern and the second layout pattern.

35. The speaker device as claimed in claim 34, wherein in at least one of the flat speaker units, the first layout pattern and the second layout pattern are constituted by a configuration or a disposition location of the plurality of supporting members.

36. The speaker device as claimed in claim 25, wherein the plurality of flat speaker units is connected to a signal source, which respectively provides audio signals of different polarities to the electrode structure, the first conductive electrode, and the second conductive electrode of each of the plurality of flat speaker units to vibrate the first vibrating membrane and the second vibrating membrane, thereby the speaker device produces sounds with different frequencies.

37. The speaker device as claimed in claim 25, wherein in one of the plurality of flat speaker units, the first conductive electrode and the second conductive electrode are constituted by metals, a plurality of metal combinations (alloys), metal electrodes, and polymers.

38. The flat speaker unit as claimed in claim 1, further comprising two barrier layers being respectively disposed on an external side of the first conductive electrode of the first vibrating membrane and on an external side of the second conductive electrode of the second vibrating membrane.

39. The flat speaker unit as claimed in claim 25, further comprising two barrier layers being respectively disposed on an external side of the first conductive electrode of the first vibrating membrane and on an external side of the second conductive electrode of the second vibrating membrane.

* * * * *